US005692371A

United States Patent [19]

Varshay et al.

[11] Patent Number: 5,692,371

[45] Date of Patent: Dec. 2, 1997

[54] UNDERWATER TWO PHASE RAMJET ENGINE

[76] Inventors: Hezi Varshay, 62 Weizmann Blvd., Netanya 42253; Alon Gany, 22 Shlomzion Hamalka, Haifa 34406, both of Israel

[21] Appl. No.: 736,115

[22] Filed: Oct. 24, 1996

Related U.S. Application Data

[62] Division of Ser. No. 268,586, Jun. 30, 1994, Pat. No. 5,598,700.

[51] Int. Cl.[6] ..... B63H 11/00

[52] U.S. Cl. ..... 60/221; 440/44

[58] Field of Search ..... 60/221, 222; 440/44, 440/45

[56] References Cited

U.S. PATENT DOCUMENTS

| | | | |
|---|---|---|---|
| 1,179,181 | 9/1916 | Buck . | |
| 1,375,601 | 4/1921 | Morize | 440/45 |
| 2,351,750 | 6/1944 | Fawkes | 440/45 |
| 2,447,100 | 8/1948 | Stalker . | |
| 2,743,698 | 5/1956 | Leonard et al. . | |
| 2,971,325 | 2/1961 | Gongwer | 60/221 |
| 3,035,409 | 5/1962 | Pifer . | |
| 3,153,905 | 10/1964 | Campbell . | |
| 3,163,980 | 1/1965 | Turner . | |
| 3,171,379 | 3/1965 | Schell, Jr. et al. . | |
| 3,183,878 | 5/1965 | Aschauer . | |
| 3,214,903 | 11/1965 | Cochran . | |
| 3,265,027 | 8/1966 | Brown et al. . | |
| 3,273,333 | 9/1966 | Roulund . | |
| 3,342,032 | 9/1967 | Cox et al. . | |
| 3,365,891 | 1/1968 | Williams . | |
| 3,380,663 | 4/1968 | Jumelle . | |
| 3,411,301 | 11/1968 | Olsen . | |
| 3,772,886 | 11/1973 | Cameron . | |
| 3,776,173 | 12/1973 | Horwitz . | |
| 3,808,804 | 5/1974 | Scott-Scott | 440/45 |
| 3,872,665 | 3/1975 | Jarry . | |
| 3,889,623 | 6/1975 | Arnold . | |
| 3,907,221 | 9/1975 | Goodrich . | |
| 4,057,961 | 11/1977 | Payne . | |
| 4,343,611 | 8/1982 | Scott-Scott . | |
| 4,718,870 | 1/1988 | Watts . | |
| 4,739,932 | 4/1988 | Szuminski et al. . | |
| 4,767,364 | 8/1988 | Lenz . | |
| 4,862,820 | 9/1989 | Guezou et al. . | |
| 4,917,637 | 4/1990 | Soga et al. . | |
| 5,267,883 | 12/1993 | Gudmundsen . | |

FOREIGN PATENT DOCUMENTS

| | | |
|---|---|---|
| 2 107 486 | 8/1972 | Germany . |
| 2 237 132 | 2/1974 | Germany . |
| 2 365 642 | 1/1976 | Germany . |

OTHER PUBLICATIONS

Dyer, D.F. et al, "Performance of Air–Augmented Waterjet Thrusters", Report for Office of Naval Research, Contract No. N00014–75–C–0936, Auburn Univ. Sch. of Eng. (1976).

*Primary Examiner*—Louis J. Casaregola
*Attorney, Agent, or Firm*—Mark M. Friedman

[57] ABSTRACT

An underwater two-phase ramjet engine propulsion unit, including an inlet for receiving a flow of water, compressed gas injector for injecting compressed gas into the flow of water, a mixing chamber for mixing the compressed gas with the flow of water to provide a two-phase flow of working fluid and a nozzle for accelerating the two-phase flow of working fluid so as to generate a two-phase jet. The propulsion unit can be implemented with a fixed geometry or with a variable geometry. The propulsion unit includes a supersonic gas injector as well as a subsonic gas injector. The propulsion unit includes a control system for controlling the compressor, supersonic gas injector, the subsonic gas injector, the geometry of the propulsion unit, and the direction of the thrust vector.

20 Claims, 22 Drawing Sheets

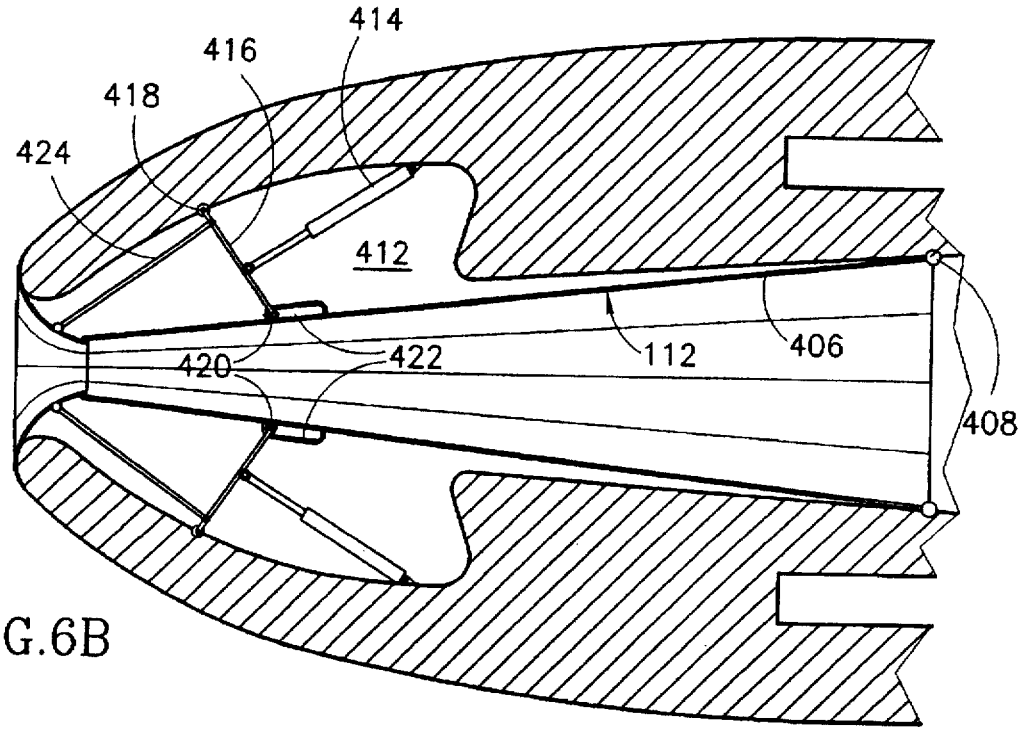
FIG.6B
FIG.6C
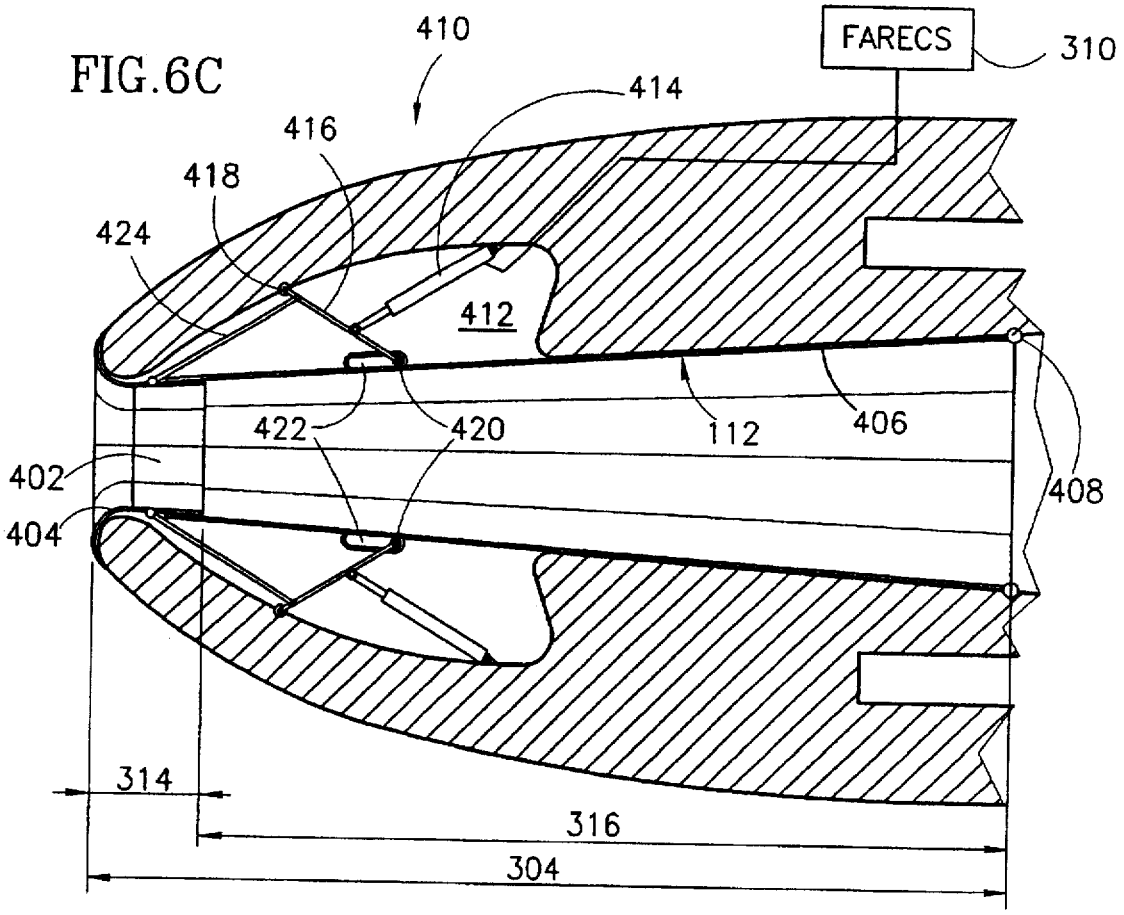

UNDERWATER TWO PHASE RAMJET ENGINE

This is a divisional application of U.S. patent application Ser. No. 08/268,586, filed Jun. 30, 1994 (U.S. Pat. No. 5,598,700).

FIELD AND BACKGROUND OF THE INVENTION

This present invention relates to two-phase marine propulsion systems in general and more particularly to underwater two-phase ramjet engines.

Various attempts have been made to develop water breathing derivatives of gas breathing jet engines for significantly broadening the performance envelope of high speed marine vessels. Fundamentally, water breathing ramjet engines operate on the principle of energizing and accelerating water with compressed gas or the combustion products of a gas generator as described in U.S. Pat. No. 3,171,379 entitled "The Hydro-Pneumatic Ram-Jet" to Schell et al. and commonly known as the "Marjet". According to Newton's $1^{st}$ Law, the propulsion system exerts thrust by applying an equal and opposite force upon an adjacent medium. In the case of a fluid medium, according to Newton's $2^{nd}$ Law, the force is equal to the rate of change of the fluid's momentum. The part of the fluid which undergoes the momentum change is called the "working fluid". In an underwater two phase ramjet engine propulsion unit, the working fluid is a two-phase mixture of water and gas, preferably air. The bubbly flow is typified by high density with compressibility due to the liquid phase and the gaseous phase, respectively.

Although the Marjet is the most developed system of its kind described in the prior art, it nevertheless suffers from several significant disadvantages which can be attributed to its lack of commercialization. The disadvantages of the Marjet include: First, poor mixing efficiency leading to low total propulsion efficiency. Second, gas introduction through a homogeneous porous jacket creating bubbles with a very narrow size distribution, thereby limiting the maximum volumetric portion of gas in the two-phase working fluid and so significantly limiting the craft's agility. Third, the inability to convert the gas's thermal energy into thrust power. Fourth, poor acceleration capability near stagnation and at low speed and limited acceleration potential, yielding inability to dash over the drag hump of hydrofoils or hovercraft. And still other disadvantages include that the thrust level is coupled with cruise speed, the propulsion unit does not display thrust reversal or integral steering capability and that propulsion and other hydrodynamic functions such as: sea keeping, active stabilization, lift, steering and thrust reversal are each carried out by dedicated systems.

Other developments include the Hydro-Pulse-Jet as described in Los Alamos National Laboratory Report LA-10358-MS, May 1985 in which the pulse jet device was considered for the propulsion of torpedo missiles. The only advantage of this development is its high speed capability while its disadvantages include it being complex, unsafe, water pollutant, very heavy, inefficient, costly, etc.

Another development includes the Gas-Augmented-Water-Jet as described in Report N 00014-75-C-0936 for the Office of Naval Research, Auburn University Ala., Mech. Eng. Department, November 1976 in which a water pump with an additional gas booster unit is provided in the pump's exhaust duct. The gas booster is unable to operate without the waterjet pump prior to it and, therefore, this arrangement has all the disadvantages of an impeller-based waterjet, plus the extra complexity of the gas booster, in exchange for extra power at high speed cruise.

Yet another development includes the "Water-Augmented-Gas-Jet" as described in U.S. Pat. No. 3,808,804 to Scott-Scott in which a propulsion unit includes a gas breathing turbofan engine, incorporating a mist booster unit in the exhaust duct, fed through water injectors, pipe lines and water pumps. This arrangement appears promising for high speed applications, but has severe safety and efficiency limitations when maneuvering in a harbor, near other craft, and at low speed.

The object of the present invention is to provide a novel two-phase underwater ramjet engine, free of the above mentioned disadvantages.

SUMMARY OF THE INVENTION

The object of the present invention is to provide a number embodiments of two-phase ramjet engine propulsion units having either fixed geometry or variable geometry configurations.

Hence, according to the first aspect of the present invention, there is provided an underwater two-phase ramjet engine propulsion unit, comprising: (a) an inlet for receiving a flow of water; (b) compressed gas injection means for injecting compressed gas into the flow of water; (c) a mixing chamber for mixing the compressed gas with the flow of water to provide a two-phase flow of working fluid; and (d) a nozzle for accelerating the two-phase flow of working fluid so as to generate a two-phase jet, characterized in that the compressed gas injection means includes a supersonic gas injector.

According to a feature of the present invention, the cross sectional area of the mixing chamber is greater than the cross sectional area of the exit of the inlet.

According to still further features of the present invention, the compressed gas injection means includes at least one from the group consisting of: an annular shower head; a perforated circumferential jacket; a center-body shower head; at least one radial supporting arm; at least one array of nozzles; and at least one perforated sheet; a subsonic gas injector; at least one swirling vane; a plurality of perforations of different sized apertures; and a plurality of perforations of different shaped apertures. Also, the compressed gas injection means injects portions of the flow of gas at different injection rates.

According to yet still further features of the present invention, the propulsion unit includes a pressure transducer for measuring at least one from the group consisting of: ambient pressure; the pressure of the water in the inlet; the static pressure of the pre-injection compressed gas in the compressed gas injection means; the total pressure of the pre-injection compressed gas in the compressed gas injection means; the pressure of the two-phase flow in the mixing chamber; the pressure of the two-phase jet at the throat of the nozzle; and the pressure of the two-phase jet at the exit of the nozzle.

According to yet still further features of the present invention, the propulsion unit includes a temperature sensor for measuring at least one from the group consisting of: the ambient temperature of the water; the temperature of the pre-injection compressed gas; and the temperature of the post-injection compressed gas.

According to yet still further features of the present invention, the propulsion unit includes control means for controlling at least one from the group consisting of: the pressure of the compressed gas; the mass flow rate of the compressed gas; distribution of the compressed gas between the compressed gas injection means; the temperature of the compressed gas; the cross sectional area of the inlet; the rate of change of the cross sectional area of the inlet; the cross sectional area of the throat of the nozzle; the cross sectional area of the exit of the nozzle; the direction of the nozzle; and the operation of a jet deflector apparatus.

According to yet still further features of the present invention, the inlet has a selectively variable internal geometry. The inlet includes an inlet cowl having a selectively variable cross sectional area wherein the inlet includes a plurality of overlapping conic segments so as to enable the cross sectional area of the inlet cowl to be selectively varied. Alternatively, the propulsion unit includes a mouse displaceable along the axis of the propulsion unit so as to enable the cross sectional area of the inlet cowl to be selectively varied. Or alternatively, the propulsion unit includes at least one displaceable inlet wall so as to enable the cross sectional area of the inlet cowl to be selectively varied. The cross sectional area of the inlet cowl can be selectively varied between about a tenth of the cross sectional area of the mixing chamber and about a half of the cross sectional area of the mixing chamber.

According to yet still further features of the present invention, the inlet includes a diffuser having a selectively variable rate of change of cross sectional area along the longitudinal axis of the propulsion unit wherein the diffuser includes a plurality of overlapping conic segments so as to enable the rate of change of the cross sectional area of the diffuser to be selectively varied. Alternatively, the propulsion unit includes a mouse displaceable along the axis of the propulsion unit so as to enable the rate of change of the cross sectional area of the diffuser to be selectively varied. Or alternatively, the propulsion unit includes at least one displaceable inlet wall so as to enable the rate of change of the cross sectional area of the diffuser to be selectively varied. The angle of divergence of the diffuser can be selectively varied between about −10° and about 10°.

According to yet still further features of the present invention, the nozzle has a selectively variable geometry wherein the nozzle includes a throat having a selectively variable cross sectional area and an exit having a selectively variable cross sectional area. The nozzle includes a plurality of overlapping conic segments so as to enable the selectively variable cross sectional area. Alternatively, the nozzle includes at least one displaceable throat wall and at least one displaceable exit wall. The cross sectional area of the throat of the nozzle can be selectively varied between about a third of the cross sectional area of the mixing chamber and about substantially the same as the cross sectional area of the mixing chamber. The cross sectional area of the exit can be selectively varied between about a quarter of the cross sectional area of the mixing chamber and about slightly greater than the cross sectional area of the mixing chamber.

According to yet still further features of the present invention, the propulsion unit includes jet deflecting means for deflecting the two-phase jet.

According to a second aspect of the present invention there is provided, an underwater two-phase ramjet engine propulsion unit, comprising: (a) an inlet for receiving a flow of water; (b) compressed gas injection means for injecting compressed gas into the flow of water; (c)a mixing chamber for mixing the compressed gas with the flow of water to provide a two-phase flow of working fluid; and (d) a nozzle for accelerating the two-phase flow of working fluid so as to generate a two-phase jet, characterized in that the inlet has a selectively variable internal geometry.

According to a third aspect of the present invention, there is provided an underwater two-phase ramjet engine propulsion unit, comprising: (a) an inlet for receiving a flow of water; (b) compressed gas injection means for injecting compressed gas into the flow of water; (c) a mixing chamber for mixing the compressed gas with the flow of water to provide a two-phase flow of working fluid; and (d) a nozzle for accelerating the two-phase flow of working fluid so as to generate a two-phase jet, characterized in that the nozzle has a selectively variable geometry.

BRIEF DESCRIPTION OF THE DRAWINGS

The invention is herein described, by way of example only, with reference to the accompanying drawings, wherein:

FIGS. 6*b* and 6*c* show the inlet in its fully closed and fully open modes, respectively;

DESCRIPTION OF THE PREFERRED EMBODIMENTS

Figure 1A:
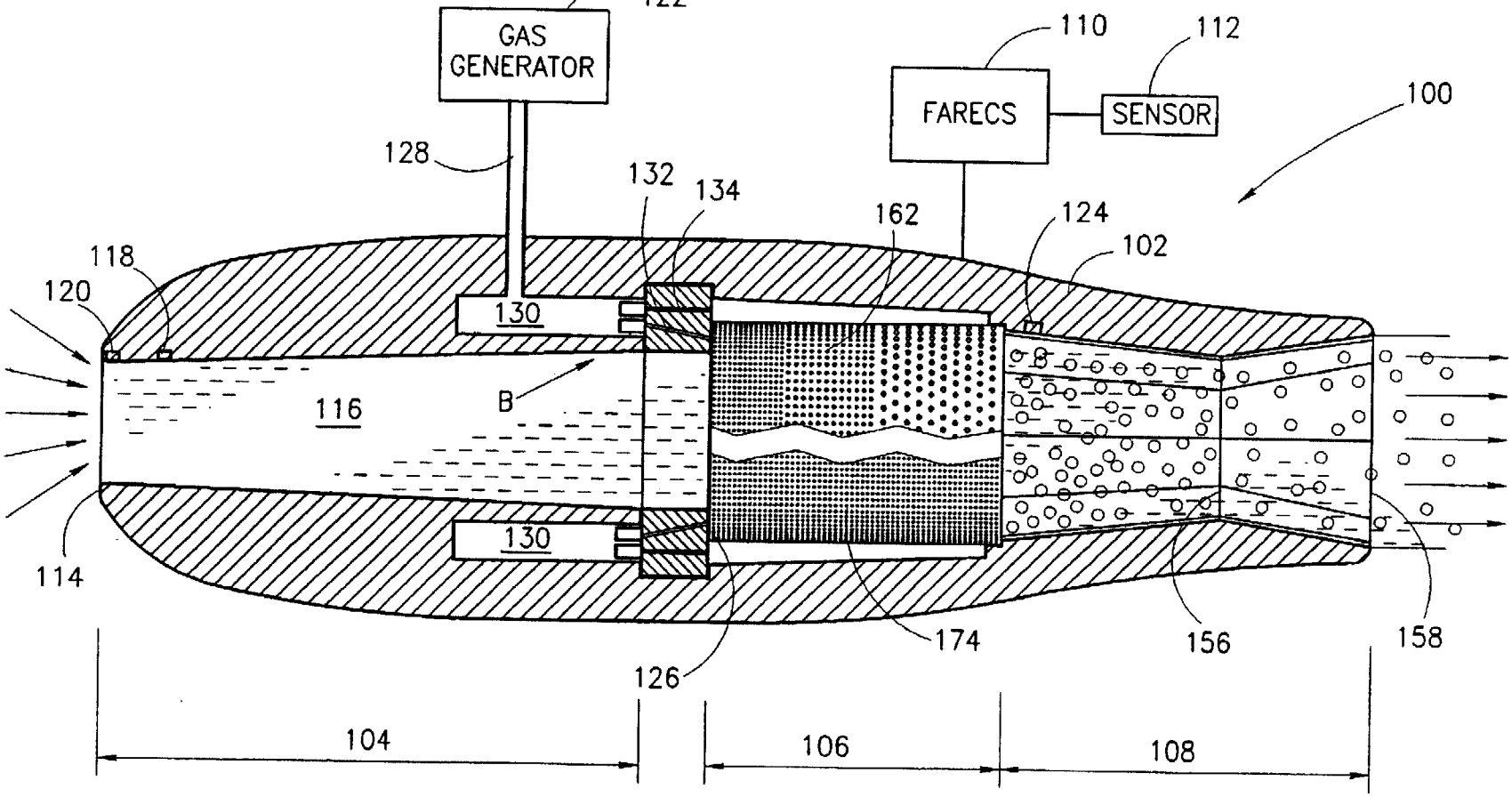
FIG. 1*a* shows a longitudinal cross sectional view of the preferred fixed geometry embodiment of the underwater two-phase ramjet engine propulsion unit according to the teachings of the present invention.
Figure 1B:
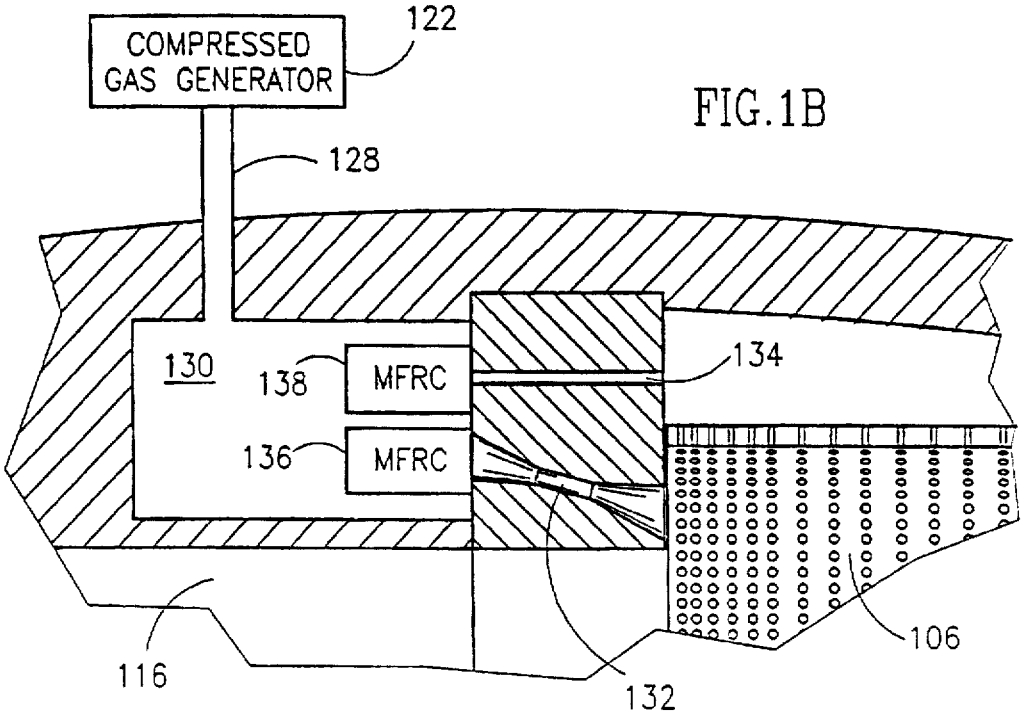
FIG. 1*b* shows a close-up view of the supersonic gas injector and the subsonic gas injector of the propulsion unit.

The present invention is of underwater two phase ramjet engine propulsion units. Specifically, the propulsion units of the present invention can be adapted for a wide range of water-based craft from jet skis and speed boats through to high performance luxury yachts, full size fast ferries and cargo ships. The propulsion units can be readily adapted to meet the demands of various mission profiles and configurations, such as underwater or surface craft, monohull, catamaran, SWATH, hydrofoil, SES, amphibious vehicle or hydro-plane.

The principles and operation of the underwater two-phase ramjet engine propulsion units according to the present invention may be better understood with reference to the drawings and the accompanying description. The description refers to propulsion units travelling through a liquid, typically water, however, it should be noted that one of the advantages of the propulsion units is that they can be propelled forward from an initial standing position, that is zero velocity, without the need for auxiliary units.

Broadly speaking, the underwater two-phase ramjet engine propulsion units of the present invention are water-breathing derivatives of an air-breathing ramjet engine and their basic construction and operation are similar to that described in U.S. Pat. No. 3,171,379 to C. J. Schell et al. As such, the propulsion units include, from upstream to downstream, an inlet, a mixing chamber and a nozzle, realizing a generally symmetrical flow duct. The flow duct can have a generally circular cross sectional profile, a generally oval cross sectional profile or a generally rectangular profile. The inlet includes an inlet cowl for receiving a flow of water at cruise speed driven by the ram dynamic pressure and a diffuser, expanding the flow duct, slowing down the flow speed of the water, thereby converting a portion of the kinetic energy of the water into potential energy. The mixing chamber mixes the water with compressed gas to generate a two phase water/gas bubbly flow which is then accelerated through the nozzle to form a two-phase water/gas jet capable of propelling the propulsion unit. All in all, propulsion is accomplished through the two-phase water/gas bubbly flow, known in the art, as the "working fluid" undergoing momentum changes on traversing through the propulsion unit.

However, the propulsion units include one or more features which enable improved performance envelope over ramjet engine propulsion units described in the prior art. One such feature is that the operation of the propulsion units are under the control of a Full Autonomy Ramjet Engine Control System (FARECS) designed for optimizing the propulsive potential of the propulsion units. This optimization leads to a significant improvement in the marine vessel's total handling characteristics such as controllability, maneuverability, safety, readiness and maintainability.

In principle, the FARECS is similar to computerized control systems in service for aerospace applications and therefore well within the purview to those skilled in the art. The sophistication of the FARECS correlates to the complexity of the propulsion unit, the performance demands on the craft, and the like. Typically, the FARECS receives input parameters from cockpit related transducers, for example, desired speed, direction, manoeuver and the like and input from ramjet related transducers deployed within the propulsion units. The FARECS then applies routines to provide multi-channel output for regulating the subsystems of the propulsion units to regulate performance parameters, such as, water mass flow rate, thrust level, and the like. The routines and desired operating parameters can be arranged in multi-dimensional data bases and integrated with hardware as known in the art.

Figure 2A:
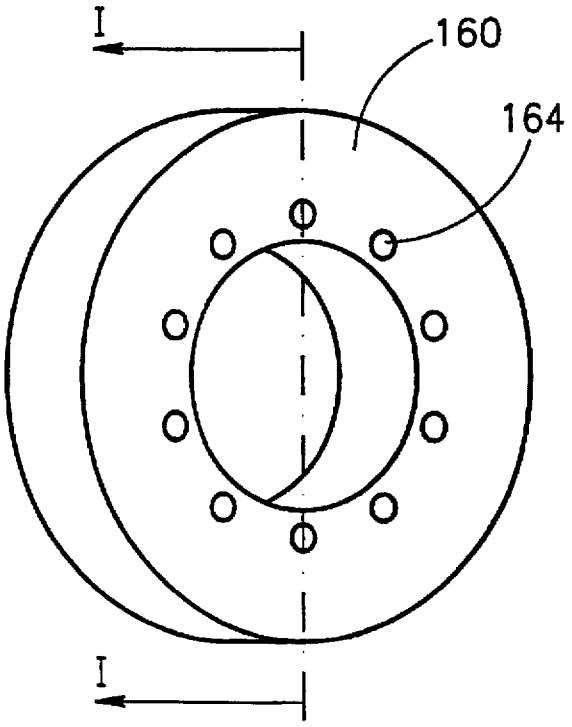
FIGS. 2*a* and 2*b* show a perspective view and a cross sectional view along line I—I of the perspective view of the supersonic gas injector.
Figure 2B:
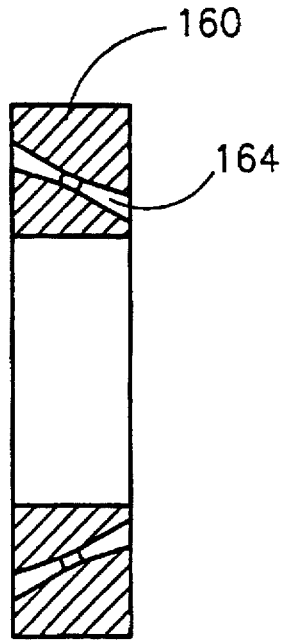
Figure 2C:
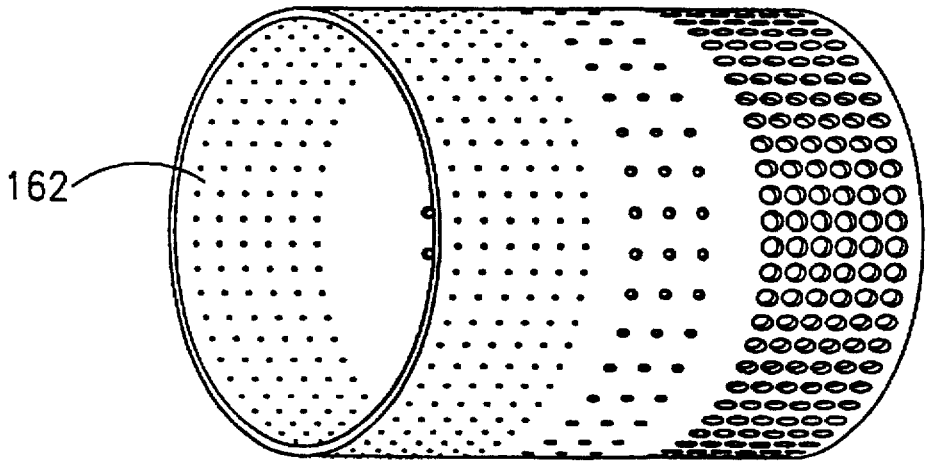
FIG. 2*c* shows a perspective view of the multi-modal perforated circumferential jacket of the subsonic gas injector.
Figure 3A:
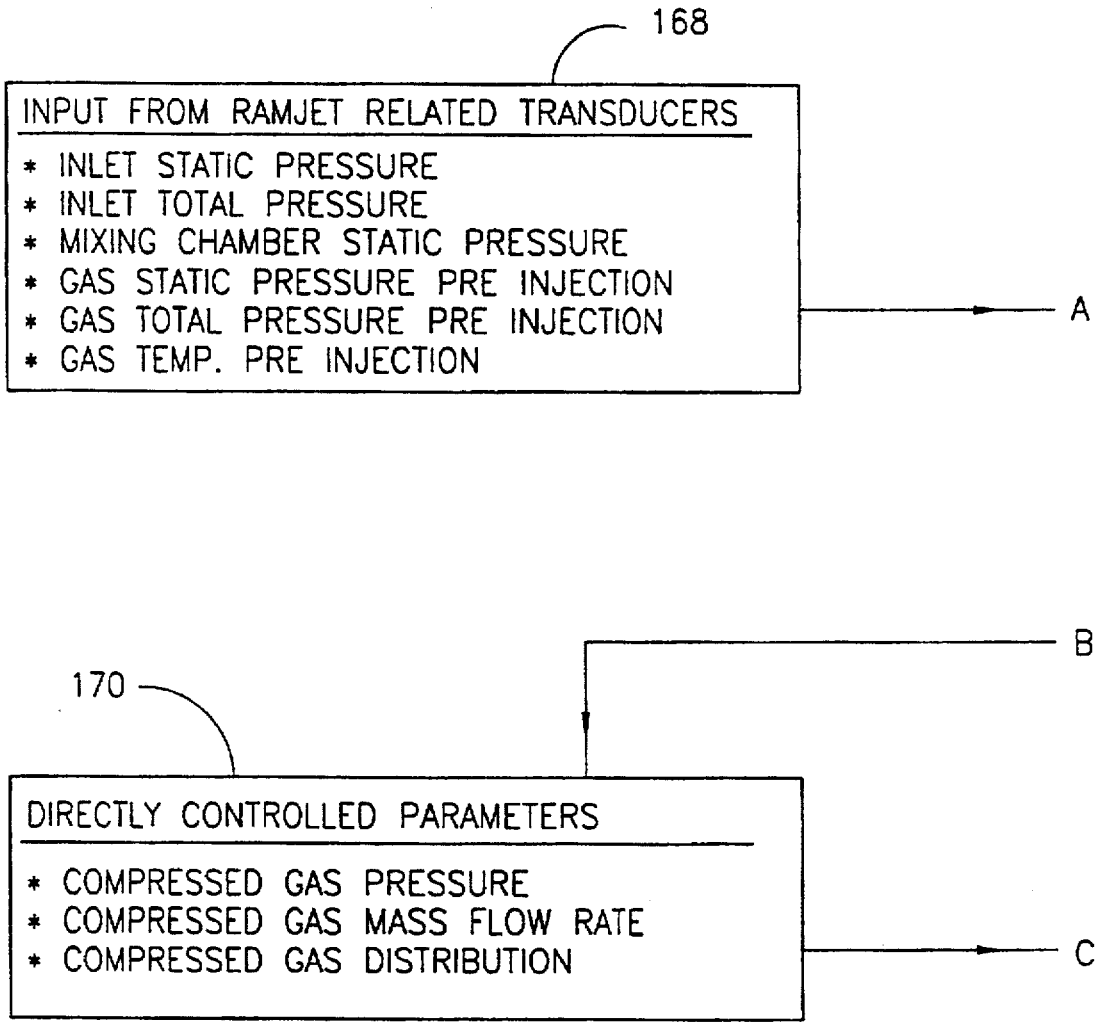
FIGS. 3A and 3B show a block diagram of the Full Autonomy Ramjet Engine Control System (FARECS) integrated with the fixed geometry propulsion unit.
Figure 3B:
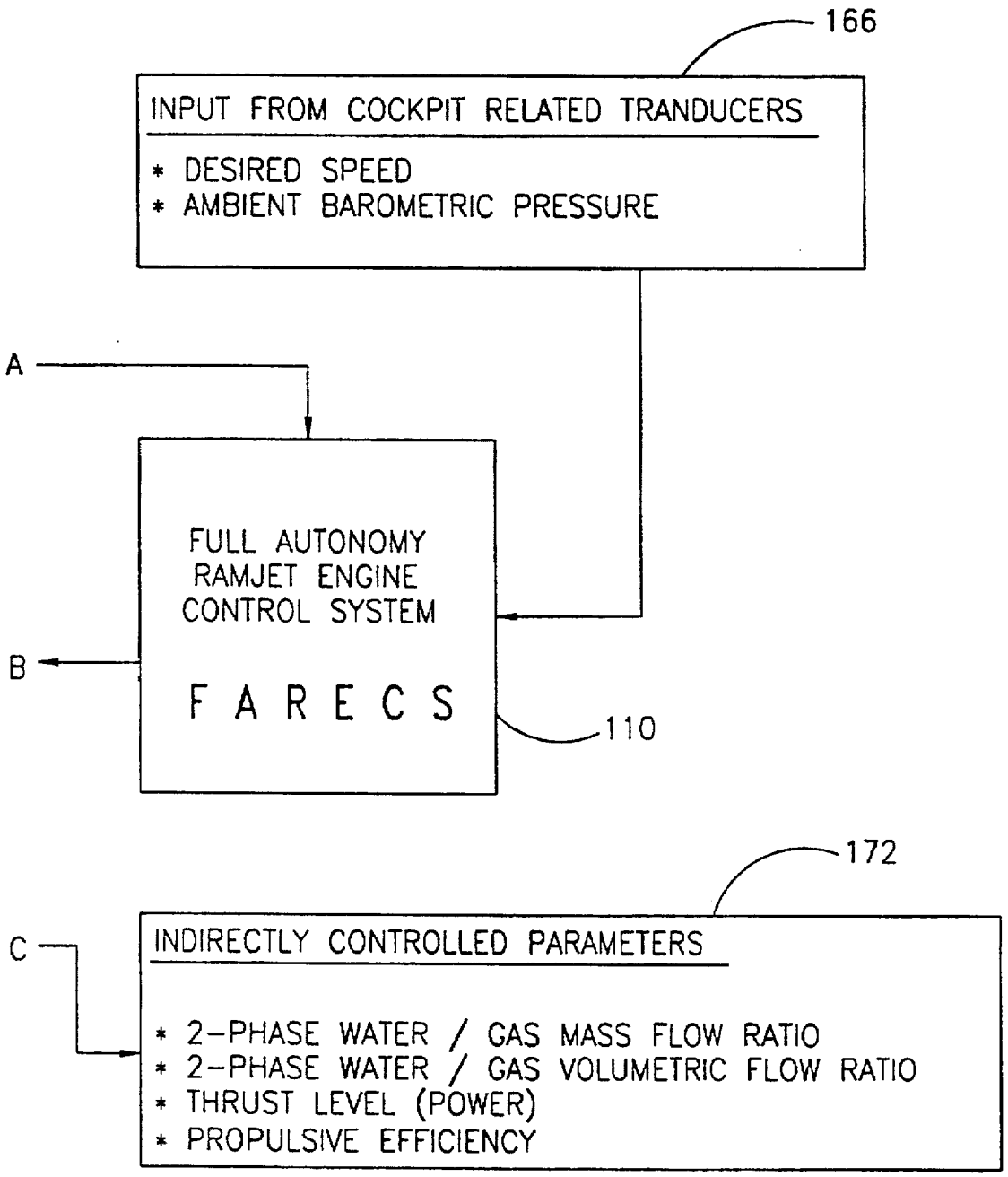

Referring now to the drawings, FIGS. 1–3 illustrate a preferred fixed geometry embodiment of an underwater two-phase ramjet propulsion unit, generally designated 100, constructed and operative according to the teachings of the present invention. In this embodiment, propulsion unit 100 has a generally cylindrical body 102 including an inlet, generally designated 104, a mixing chamber 106 and a nozzle 108. In this case, inlet 104, mixing chamber 106 and nozzle 108 realize a generally circular cross sectional profile.

Propulsion unit 100 is under the control of the basic version of Full Autonomy Ramjet Engine Control System (FARECS) 110 receiving input from the cockpit, in the form of "Desired Speed" and the ambient barometric pressure from a pressure transducer 112, and input from ramjet related transducers deployed with propulsion unit 100 for regulating a number of functions as described hereinbelow in greater detail.

Inlet 104 includes an inlet cowl 114 for receiving a flow of water at cruise speed driven by the ram dynamic pressure. Inlet 104 also includes a diffuser 116, downstream of inlet cowl 114, for expanding the intake of water, thereby converting kinetic energy into potential energy in the form of static pressure. Transducers deployed in inlet 104 for providing input to FARECS 110 preferably include a pressure transducer 118 for measuring the static pressure of the water in the vicinity of inlet cowl 114 and a pressure transducer 120 for measuring the total pressure of the water in the vicinity of inlet cowl 114.

Downstream of diffuser 116, mixing chamber 106 mixes the water with compressed gas from a compressed gas generator 122 to form a high density but compressible two-phase water/gas working fluid. A pressure transducer 124 provides the actual static pressure in mixing chamber 106 to FARECS 110. The two-phase water/gas bubbly working fluid accelerates as it flows downstream within mixing chamber 106 such that it is transformed into a two-phase water/gas jet. The cross sectional area of mixing chamber 106 is preferably greater than the cross sectional area of the exit of diffuser 116 such that an annular rim 126 is provided therebetween. The increase in cross sectional area enables a sudden expansion of the working fluid providing volume for a greater quantity of compressed gas to be mixed with the water for achieving thrust power.

Compressed gas generator 122 supplies compressed gas along a supply line 128 leading, via a calming and regulation chamber 130, to either a supersonic gas injector 132 or a subsonic gas injector 134 for injection into mixing chamber 106. FARECS 110 regulates both the pressure of the compressed gas provided by compressed gas generator 122 and the distribution of compressed gas between supersonic gas injector 132 and subsonic gas injector 134 through the use of mass flow rate controllers, 136 and 138 respectively, best seen in FIG. 1*b*.

Figure 1C:
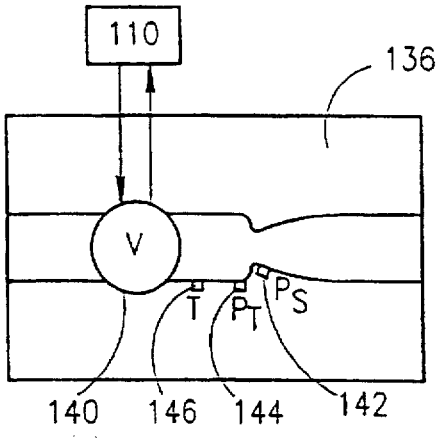
FIGS. 1*c* and 1*d* show the interior design of the mass flow rate controllers of the supersonic gas injector and the subsonic gas injector, respectively.
Figure 1D:
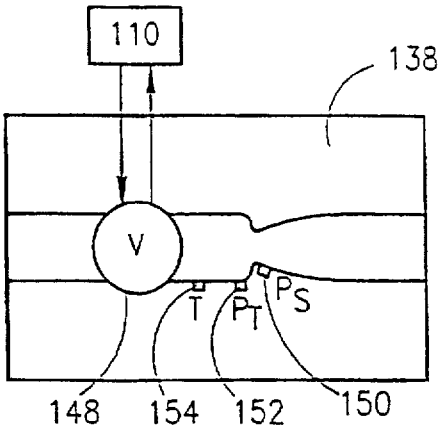

Turning briefly to FIG. 1*c*, mass flow rate controller 136 of supersonic gas injector 132 includes a variable valve 140 under the control of FARECS 110 for determining the mass flow rate of compressed gas therethrough, a pressure transducer 142 for measuring the pre-injection static pressure of the compressed gas, a pressure transducer 144 for measuring the pre-injection total pressure of the compressed gas and a temperature sensor 146 for measuring the pre-injection temperature of the compressed gas. In a similar fashion as shown in FIG. 1*d*, mass flow rate controller 138 of subsonic gas injector 134 includes a variable valve 148 under the control of FARECS 110 for determining the mass flow rate of compressed gas therethrough, a pressure transducer 150 for measuring the pre-injection static pressure of the compressed gas, a pressure transducer 152 for measuring the pre-injection total pressure of the compressed gas and a temperature sensor 154 for measuring the pre-injection temperature of the compressed gas.

Turning back to FIG. 1*a*, on induction into nozzle 108, the two-phase jet continues to accelerate as it approaches throat 156 of nozzle 108, due to a decrease in the cross sectional area of the flow duct and a decrease in the density of the working fluid, while the mass flow rate of the working fluid remains continuous and steady. When reaching throat 156, the two-phase water/gas jet should preferably be at choke. Further acceleration of the two-phase water-gas jet is achieved through nozzle divergence between throat 156 and exit 158 of nozzle 108 due to work that the bubbles exert on the water as they expand until the static pressure of the two-phase jet equalizes with the ambient static pressure prevailing outside propulsion unit 100 as the jet is discharged through exit 158. Hence, the propulsion thrust provided by underwater two-phase ramjet engine propulsion unit 100 is accomplished through the conversion from the pressure potential energy of the two-phase water/gas bubbly flow to kinetic energy of the two-phase jet.

With reference now to FIGS. 2*a*–2*c*, supersonic gas injector 132 is preferably in the form of an annular shower head 160 deployed between regulation chamber 130 and mixing chamber 106 for oblique injection of compressed gas toward the axis of mixing chamber 106 while subsonic gas injector 134 is preferably in the form of a multi-modal circumferential jacket 162 for radial injection of compressed gas towards the axis of mixing chamber 106.

As best seen in FIGS. 2*a* and 2*b*, supersonic gas injector 132 provides compressed gas through a series of converging-diverging ports 164 for harnessing the thermal energy of the compressed gas and converting it into kinetic energy, which, in turn, generates thrust. The conversion of thermal energy into thrust is achieved by two thermodynamic mechanisms. First, when the injected gas is cooler than the water that it is to be injected into, thermal energy is extracted from the water, thereby providing for expansion of the compressed gas and the acceleration of the two-phase bubbly flow downstream so as to increase thrust efficiency. And second, the compressed gas jets convey some of their energy to the water via viscous friction, thereby also accelerating the two-phase bubbly flow downstream. Hence, it can be readily appreciated that supersonic gas injection serves as a unique mechanism both for acceleration of propulsion unit 100 from zero velocity and for efficient extra thrust boost.

Subsonic gas injector 150 provides compressed gas through perforated circumferential jacket 162 in the form of a very large number of bubbles for mixing intimately with the water to generate a generally homogeneous two-phase bubbly flow. The velocity of the subsonic gas injection is kept small relative to the water to maximize efficiency. Within the two-phase bubbly flow, each bubble acts directly against an incremental portion of water, such that the bubbly flow is efficiently accelerated downstream. Perforated circumferential jacket 162 is preferably multi-modal so as to increase the volumetric fraction of compressed gas which can be injected in the water while maintaining a bubbly regime rather than if a single size perforation 174. However, a low cost, single size perforated circumferential jacket can also be employed in a simplified version of propulsion unit 100. Furthermore, subsonic gas injection can also be performed through annular shower head 160.

Other developments which can be implemented in supersonic gas injector 132 and subsonic gas injector 134 for facilitating better control over the envelope of mass flow ratio between the phases and therefore the envelope of power input into the working fluid and its conversion into propulsive power include: supersonic and subsonic gas injection provided with or without swirl of the gas jets; supersonic and subsonic gas injection with or without intercrossing of the gas jets; variable supersonic and subsonic gas injection velocity profile; and supersonic and subsonic gas injection through perforations having a non-uniform distribution of diameters and shapes with or without respect to location of the injection port.

With reference now to FIG. 3, for the fixed geometry basic propulsion unit 100, the input to FARECS 110 and the multi-channel output from FARECS 110 are now summarized in table format. Hence, the input from the cockpit of the craft is summarized in a block denoted 166 and entitled "INPUT FROM COCKPIT RELATED TRANSDUCERS" while the input from the pressure transducers, temperature sensors and other devices deployed within propulsion unit 100 is summarized in a block denoted 168 and entitled "INPUT FROM RAMJET RELATED TRANSDUCERS". In a similar fashion, the output from FARECS 110 is summarized in a block denoted 170 and entitled "DIRECTLY CONTROLLED PARAMETERS". The performance characteristics of propulsion unit 100 which are modified as a result of the regulation of the "DIRECTLY CONTROLLED PARAMETERS" are summarized in a block denoted 172 and entitled "INDIRECTLY CONTROLLED PARAMETERS".

Hence, the input in block 166 to FARECS 110 includes, but is not limited to: "Desired Speed" from a manual input interface such as a keyboard or a throttle and Ambient Barometric Pressure from transducer 112. The input in block 168 includes, but is not limited to: "Inlet Static Pressure" from transducer 118; "Inlet Total Pressure" from transducer 120; "Mixing Chamber Static Pressure" from transducer 124; supersonic pre-injection "Gas Static Pressure" from transducer 142; supersonic pre-injection "Gas Total Pressure" from transducer 144; supersonic pre-injection "Gas Temperature" from temperature sensor 146; subsonic pre-injection "Gas Static Pressure" from transducer 150; subsonic pre-injection "Gas Total Pressure" from transducer 152; and subsonic pre-injection "Gas Jet Temperature" from temperature sensor 154.

The multi-channel output in block 170 includes, but is not limited to regulation of: "Compressed Gas Pressure" supplied by compressed gas generator 122; "Compressed Gas Mass Flow Rate" of supersonic gas injector 132 via controller 136; "Compressed Gas Mass Flow Rate" of subsonic gas injector 134 via controller 138; and "Compressed Gas Distribution" between supersonic gas injector 132 and subsonic gas injector 134. As shown in block 172, regulation of these parameters regulates, in turn, parameters including, but not limited to: "2-Phase Water/Gas Mass Flow Ratio"; "2-Phase Water/Gas Volumetric Flow Ratio"; "Thrust Level (Power)" of propulsion unit 100; and "Propulsive Efficiency" of propulsive unit 100.

Figure 4A:
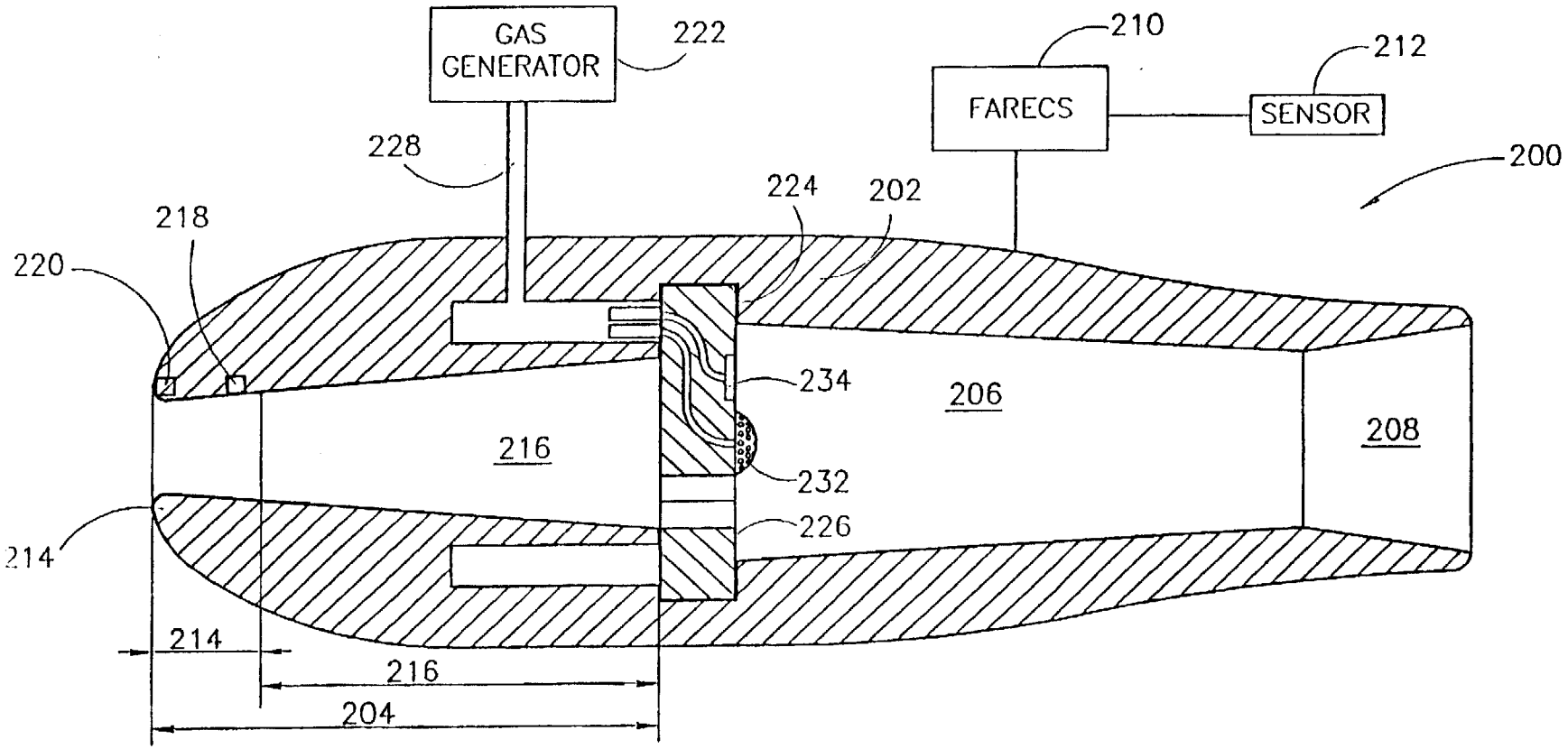
FIG. 4*a* shows a longitudinal cross sectional view of a second fixed geometry embodiment of the underwater two-phase ramjet engine propulsion unit according to the teachings of the present invention.
Figure 4B:
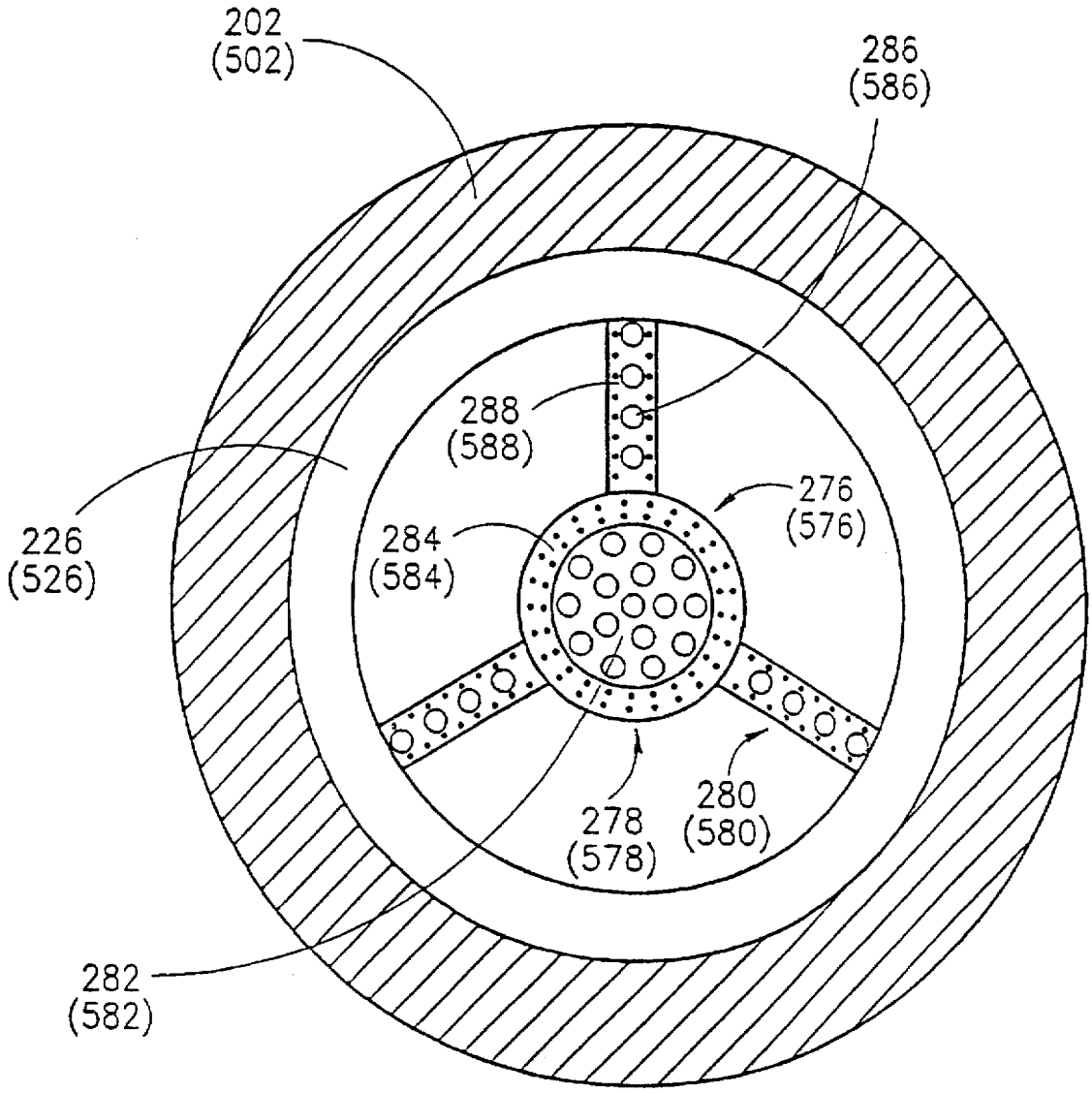
FIG. 4*b* shows a rear view of the supersonic gas injector and the subsonic gas injector of the propulsion unit of FIG. 4*a*.
Figure 5:
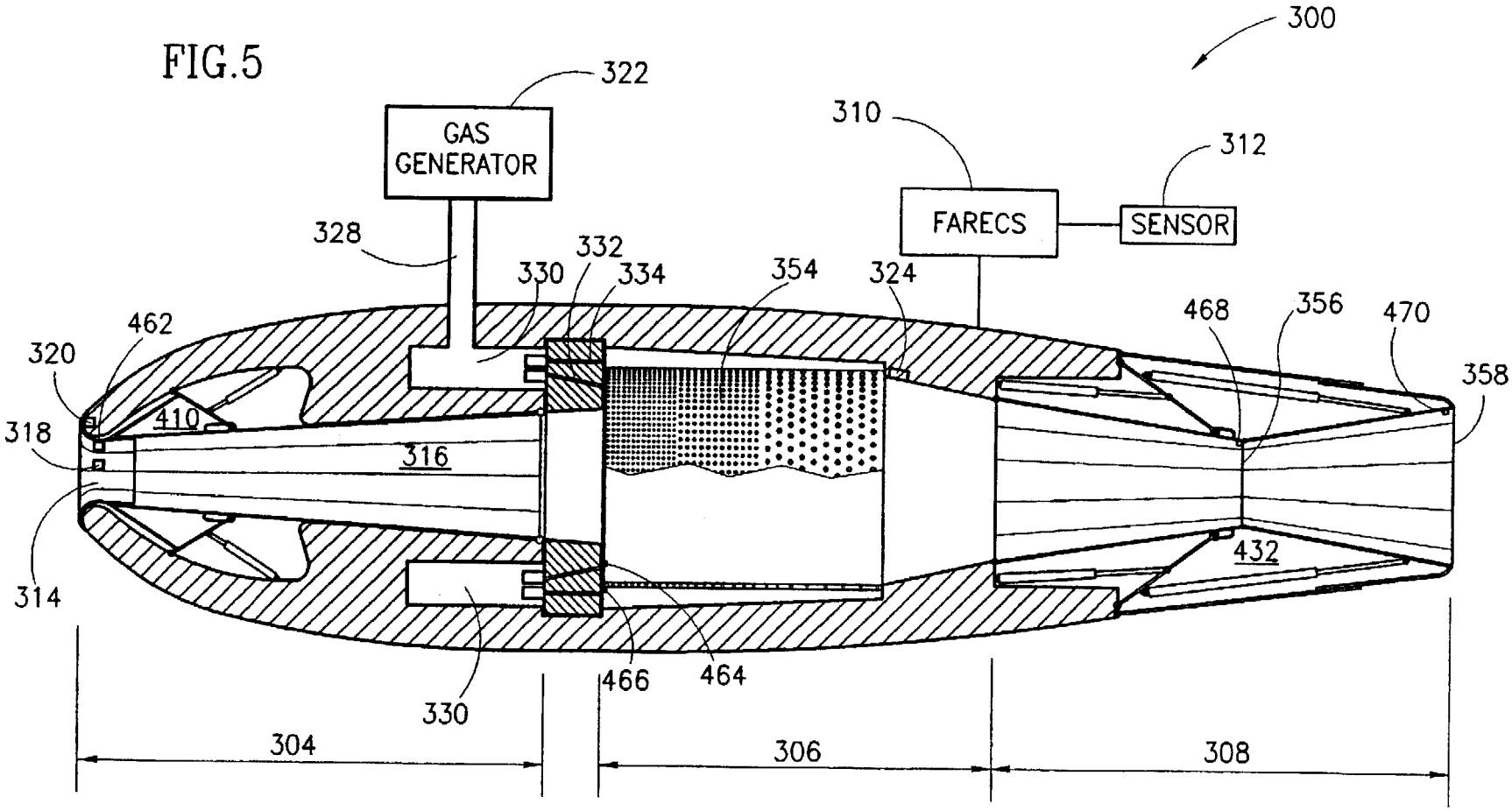
FIG. 5 shows a longitudinal cross sectional view of the preferred variable geometry embodiment of the underwater two-phase ramjet engine propulsion unit according to the teachings of the present invention.

With reference now to FIGS. 4*a* and 4*b*, a second fixed geometry embodiment of an underwater two-phase ramjet propulsion unit, generally designated 200, is shown. Propulsion unit 200 has a similar construction and operation as propulsion unit 100 and therefore similar elements are likewise numbered.

As shown, gas injection of propulsion unit 200 is through a center body, generally designated 276, which includes a shower head 278 for axial injection of compressed gas into mixing chamber 206 and supporting arms 280, extending from center body 276 to annular rim 226, for oblique injection of compressed air towards the axis of mixing chamber 206. Shower head 278 preferably includes two arrays of gas injectors, a first array 282 for supersonic gas injection and a second array 284 for subsonic gas injection. In the same manner, supporting arms 280 includes two arrays of gas injectors, a first array 286 for supersonic gas injection and a second array 288 for subsonic gas injection. Other modifications to supersonic gas injector 232 and subsonic gas injector 234 can be implemented as described hereinabove with reference to the supersonic and subsonic gas injectors of propulsion unit 100.

With reference now to FIGS. 5–9, a preferred variable geometry embodiment of an underwater two-phase ramjet propulsion unit, generally designated 300, is shown. Propulsion unit 300 has a similar construction and operation as propulsion unit 100 and therefore similar elements are likewise numbered while additional elements are numbered starting from 400. The main differences between propulsion unit 300 and propulsion unit 100 relate to inlet 304 having a variable geometry, nozzle 308 having a variable geometry, a far more sophisticated FARECS 310 and the variety of different types of compressed gas generators 322 which can be employed. The flexibility provided by these particular features of the present invention enable propulsion unit 300 to achieve performance not previously enabled by conventional propulsion units.

Inlet 304 includes inlet cowl 314 having a variable cross sectional area and diffuser 316 having a variable rate of change of cross sectional area for controlling the intake of the flow of water into propulsion unit 300. The variable geometry of inlet 304 can be implemented through conic segments in which the degree of overlapping between adjacent conic segments can be selectively varied as described below or the reciprocable displacement of a center body as described below with reference to FIGS. 10*a* and 10*b*. As shown, an inlet kinematic mechanism, generally designated 410, under the control of FARECS 310, is used for determining the cross sectional area of inlet cowl 314 and the variable rate of change of cross sectional area of diffuser 316.

Figure 6A:
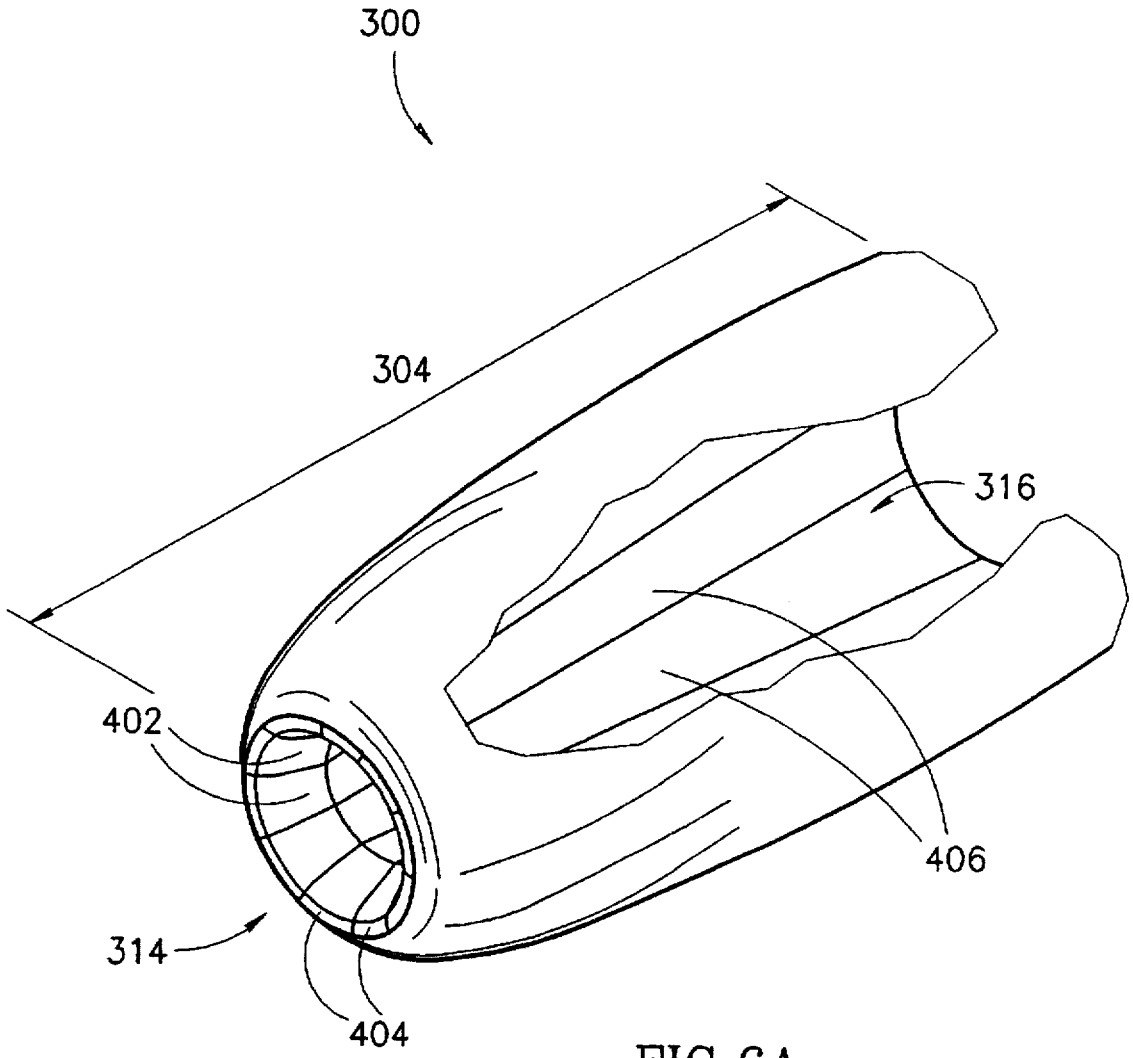
FIG. 6*a* shows a perspective view of the inlet of the propulsion unit.

Turning now to FIG. 6*a*–6*c*, inlet cowl 314 is fabricated from minor conic segments 402 extending rearward from flexible supports 404 disposed toward the front of inlet 304 while diffuser 316 is fabricated from major conic segments 406 extending from pivotable supports 408 disposed toward the rear of diffuser 316. At all times, minor conic segments 402 overlie major conic segments 408 along the longitudinal axis of propulsion unit 300 to present a smooth continuous hydrodynamic fairway to the incoming flow of water, however, the degree of overlying is adjusted according to the geometry of inlet 304.

Typically, ten minor conic segments 402 are employed to fabricate inlet cowl 314 in such a manner that its cross sectional area can be selectively varied between about a tenth to about a half of the cross sectional area of mixing chamber 306. In a similar manner, typically ten major conic segments 406 are employed to fabricate diffuser 316 in such a manner that its angle of divergence can be selectively varied between about −10° to about 10°. Typically, minor conic segments 402 and major conic segments 406 are manipulated in pairs by inlet kinematic mechanism 410.

Inlet kinetic mechanism 410 preferably manipulates each pair of minor conic segment 402 and major conic segment 406 individually as now described. Inlet kinematic mechanism 410 is housed in an annular chamber 412 disposed toward the front of propulsion unit 300. An actuator 414 pivotally mounted on wall of chamber 412 extends forward for regulating the angle of a strut 416 extending from a pivot 418 also mounted on the wall of chamber 412. The free end of strut 416 terminates as a roller 420 which reciprocates within slots 422 mounted on major conic segments 406 for selectively displacing major conic segments 406 depending on the state of actuator 414. A strut 424 is pivotally mounted on strut 416 and is also pivotally mounted on minor conic segment 402 such that activation of actuators 414 also displaces minor conic segment 402. Actuator 414 can be a hydraulic actuator, a pneumatic actuator, an electromechanical actuator and the like.

FIG. 6*b* shows inlet kinematic mechanism 410 deployed for minimizing the cross sectional area of inlet cowl 314 and maximizing the rate of change of the cross sectional area of diffuser 316, referred to as the "fully closed inlet mode" of inlet kinematic mechanism 410. In contrast to FIG. 6*b*, FIG. 6*c* shows inlet kinematic mechanism 410 deployed for maximizing the cross sectional area of inlet cowl 314 and minimizing the rate of change fo the cross sectional area of diffuser 316, referred to as the "fully open inlet mode" of inlet kinematic mechanism 410. Inlet kinematic mechanism 410 can be varied continuously from its fully closed inlet mode to its fully opened inlet mode, and vice versa, through the activation of actuators 414 by FARECS 310.

Figure 7A:
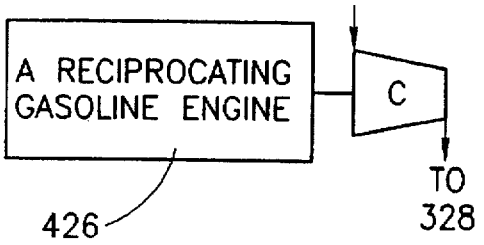
FIGS. 7*a*–7*e* show a number of arrangements of the compressed gas generator for driving the propulsion unit.
Figure 7B:
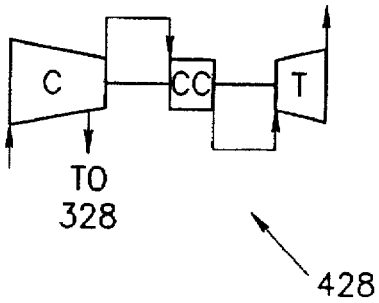
Figure 7C:
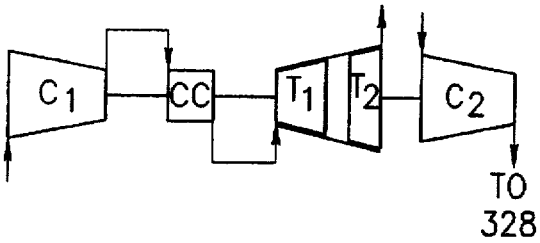
Figure 7D:
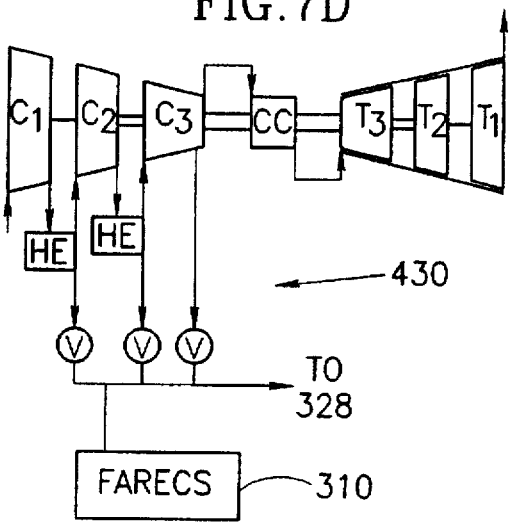
Figure 7E:
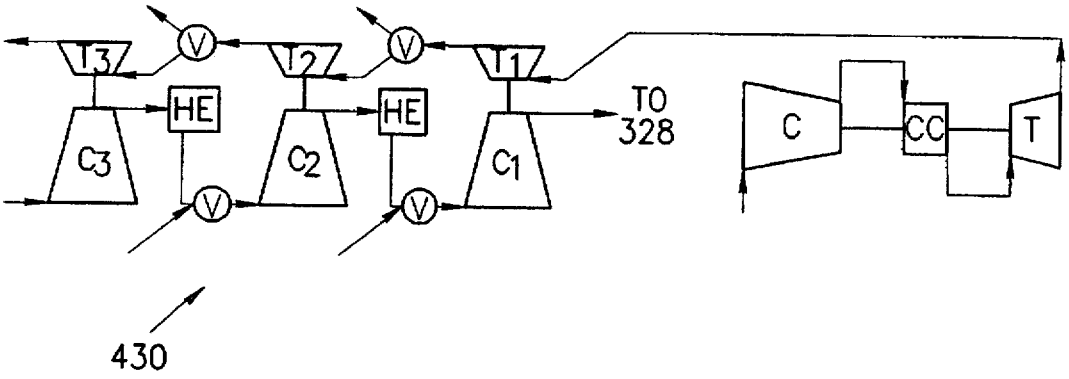

Compressed gas generator 322 typically varies according to the type of craft to be propelled by propulsion unit 300. Broadly speaking, the type of compressed gas generator 322 depends on whether the craft to be propelled is a surface going craft or an underwater craft. When propelling a surface craft, compressed gas generator 322 is preferably an air-breathing type compressor located remotely from propulsion unit 300 as now described with reference to FIGS. 7*a*–7*e*. FIG. 7*a* shows a gas compressor coupled with a reciprocating gasoline engine 426 suitable for low power and low speed applications. FIG. 7*b* shows a gas turbine 428, including a Compressor, a Combustion Chamber, and a Turbine, suitable for medium to high power and/or speed applications where compressed gas is extracted directly from the downstream end of gas turbine's compressor. FIG. 7*c* shows that compressed gas is extracted from a separate compressor $C_2$, coupled with a turbo shaft's free turbine $T_2$. Such an arrangement is suitable for medium speed applications. For ultimate speed applications, several turbo-compressors may be needed, each serving as a compression stage, with inter-cooler/s (Heat Exchanger/s) between the stages. That may be embodied with multi-spool gas generators, where the spool's axes are either coaxial and longitudinally spaced (FIG. 7*d*), or laterally spaced apart (FIG. 7*e*). When changing from low speed cruise to high speed dash, gas generation may alter from a single stage compression to multi-stage compression as shown in either FIGS. 7*d* or 7*e*, using a valving system governed by FARECS 310.

When propelling an underwater craft, compressed gas generator 322 typically needs to be integrated with propulsion unit 300 for an anaerobic mode of operation. In this case, generation of gas takes place in a special reactor chamber adjacent to mixing chamber 306 and or in an annular chamber coaxial to propulsion unit 300. Alternatively, compressed gas can be fed from a remote compressed gas generator through a pipe. In all the above mentioned arrangements, compressed gas is preferably generated either by a controlled rocket motor consuming solid or liquid fuel, single or multi-base, or by a controlled reaction between a metal, including, but not limited to, Al, B, k, Li, Na, Zr or Triethylaluminum and water. Such arrangements have been described for hydro-pneumatic ramjet engines in the prior art.

With reference now to FIGS. 8*a*–8*f*, nozzle 308 has a variable internal geometry for optimizing the performance of propulsion unit 300 by ensuring that the two-phase flow is accelerated up to choke at throat 356 of nozzle 308 while expansion is completed exactly at exit 358 of nozzle 308 for maximizing both thrust and propulsive efficiency. The variable internal geometry of nozzle 308 is preferably implemented in a similar manner as described for inlet 304, however, in practice, a more complicated nozzle kinematic mechanism 432 is needed to ensure that the cross sectional areas of both throat 356 and exit 358 can be regulated independently, thereby providing far greater control over propulsion unit 300. Typically, nozzle kinematic mechanism 432 allows up to four degree of freedom.

Hence, nozzle 308 includes conic segments 434 for regulating the cross sectional area of throat 356 and conic segments 436 for regulating the cross sectional area of exit 358. Regulation of the cross sectional areas is achieved by adjusting the degree of overlapping of adjacent conic segments. Typically, ten conic segments 434 are employed such that the cross sectional area of throat 356 can be selectively varied between about a third of the cross sectional area of mixing chamber 306 to about substantially the same as the cross sectional area of mixing chamber 306. In a similar manner, typically ten conic segments 436 are employed such that the cross sectional area of exit 358 can be selectively varied between about a quarter of the cross sectional area of mixing chamber 306 to slightly greater than the cross sectional area of mixing chamber 306. Typically, conic segments 434 and conic segments 436 are manipulated in pairs by nozzle kinematic mechanism 432. At all times, conic segments 434 and conic segments 436 present a smooth continuous hydrodynamic fairway to the two-phase jet discharged from propulsion unit 300.

Nozzle kinematic mechanism 432 is now described for a single conic segment 434 and conic segment 436 pair. The front end of conic segment 434 is supported by a flexible support 438 mounted on body 302 while its rear end is supported by a strut 440 pivotally mounted at one end to body 302 while terminating at its other end in a roller 442 which reciprocates within slots 444 mounted toward the rear end of conic segment 434. An actuator 446, pivotally mounted on body 302, under the control of FARECS 310, is employed for regulating the angle of inclination of strut 440 with respect to body 302 which, in turn, regulates the angle of inclination of conic segment 434, thereby selectively controlling the cross sectional area of throat 356.

The front end of conic segment 436 is supported by a flexible support 448 mounted on the rear end of conic segment 434 while its rear end is also pivotally supported by strut 440 via an actuator 450. Actuator 450 under the control of FARECS 310 is employed for regulating the angle of inclination of conic segment 436 with respect to conic segment 434, thereby selectively controlling the cross sectional area of exit 356.

A particular feature of nozzle 308 is that it also provides a variable selective outer surface, generally designated 452, providing propulsion unit 300 with a smooth, continuous hydrodynamic fairing providing, in turn, minimal hydrodynamic resistance (drag) through all its modes of operation. Surface 452 is fabricated from rearwardly extending conic segments 454 overlying conic segments 456. Conic segments 452 extend rearward from flexible supports 458 mounted on body 302 while conic segments 456 extend forward from flexible supports 460 mounted on the rear ends of conic segments 436. As will become apparent below, the degree of overlying between conic segments 454 and conic segments 456 varies according to the mode of operation of nozzle 308.

With reference now to FIGS. 8*c*–8*f*, variable geometry nozzle 308 of propulsion unit 300 provides a craft with steering and thrust reversal capabilities without the use of any external moving parts, such as the commonly used steerable hydraulic bucket. Steering can be achieved through two-phase jet deflection by the tilting of nozzle 308 in the required direction including horizontal (left-right) and vertical (up-down) movement. Thrust reversal can be achieved by keeping inlet 304 wide open while closing both throat 356 and exit 358 of nozzle 308 and injecting compressed gas using only subsonic gas injector 334. Any gradual change in the ratio between the cross sectional areas of inlet 304 and throat 356 and exit 358 of nozzle 308 gradually changes the degree of thrust reversal, thereby facilitating a continuous and smooth change from reverse mode to forward thrust mode, and vice versa.

Figure 8A:
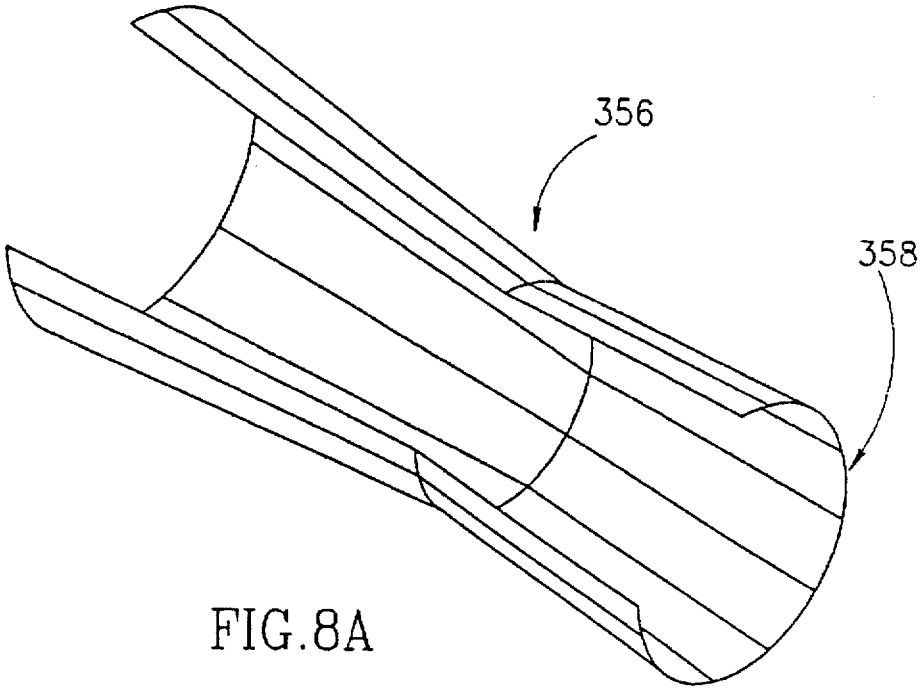
FIG. 8*a* shows a perspective view of the variable geometry nozzle.
Figure 8B:
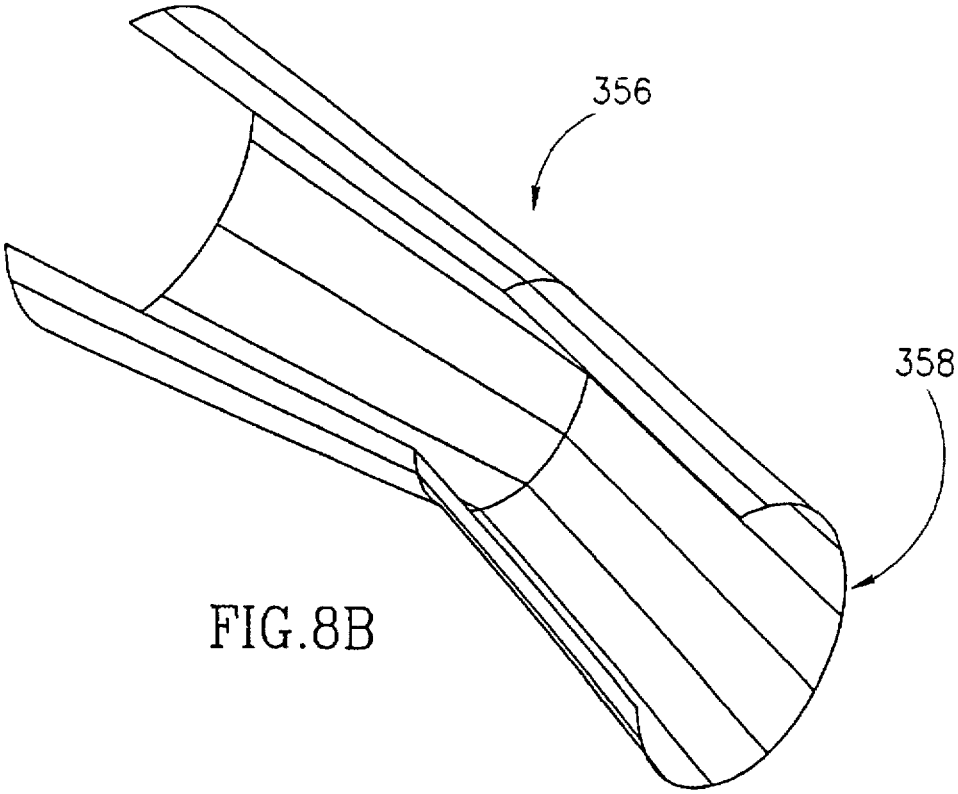
FIG. 8*b* shows a perspective view of the variable geometry nozzle deployed for steering the propulsion unit.
Figure 8C:
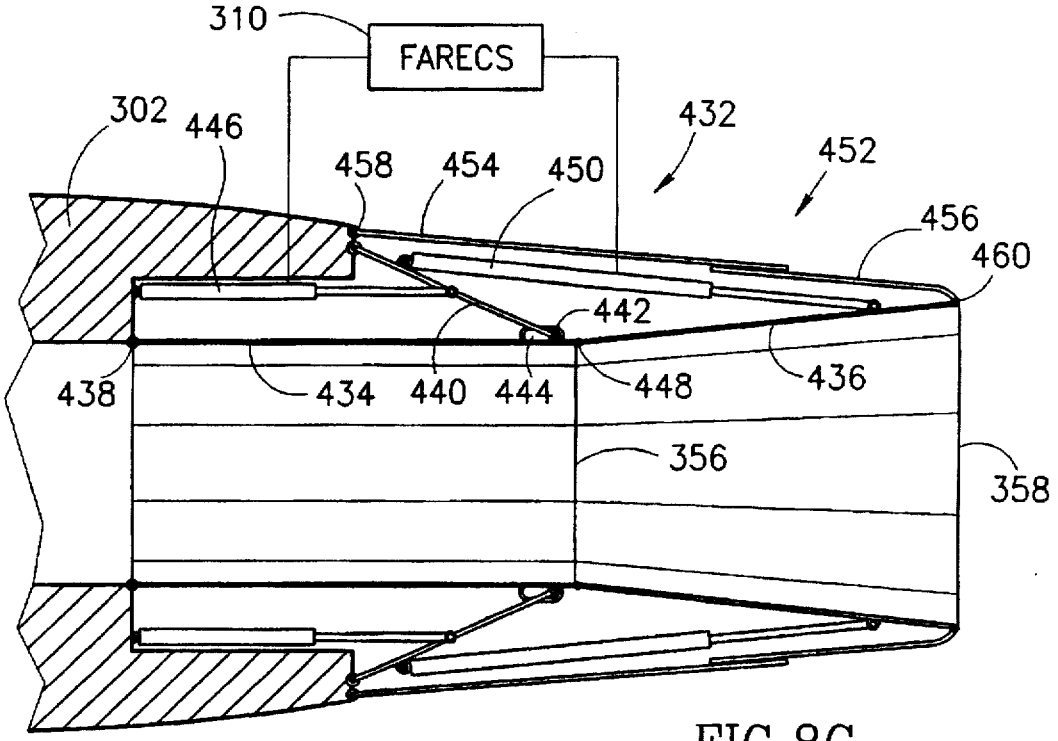
FIGS. 8*c*–8*f* show four basic modes of operation of the variable geometry nozzle.
Figure 8D:
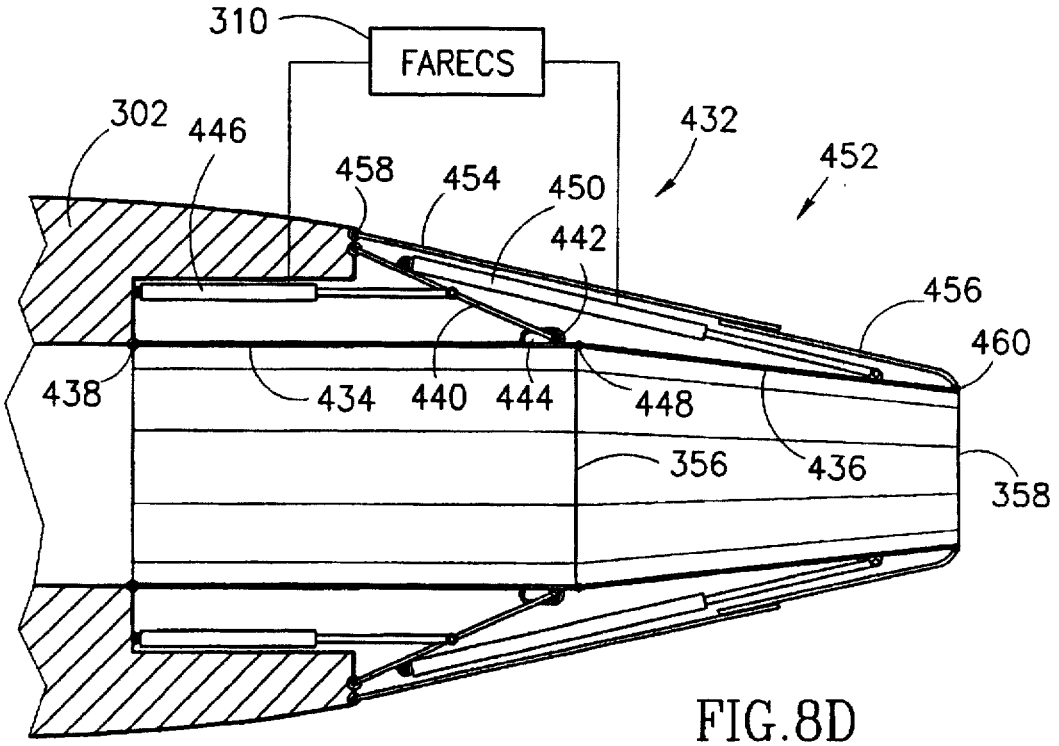
Figure 8E:
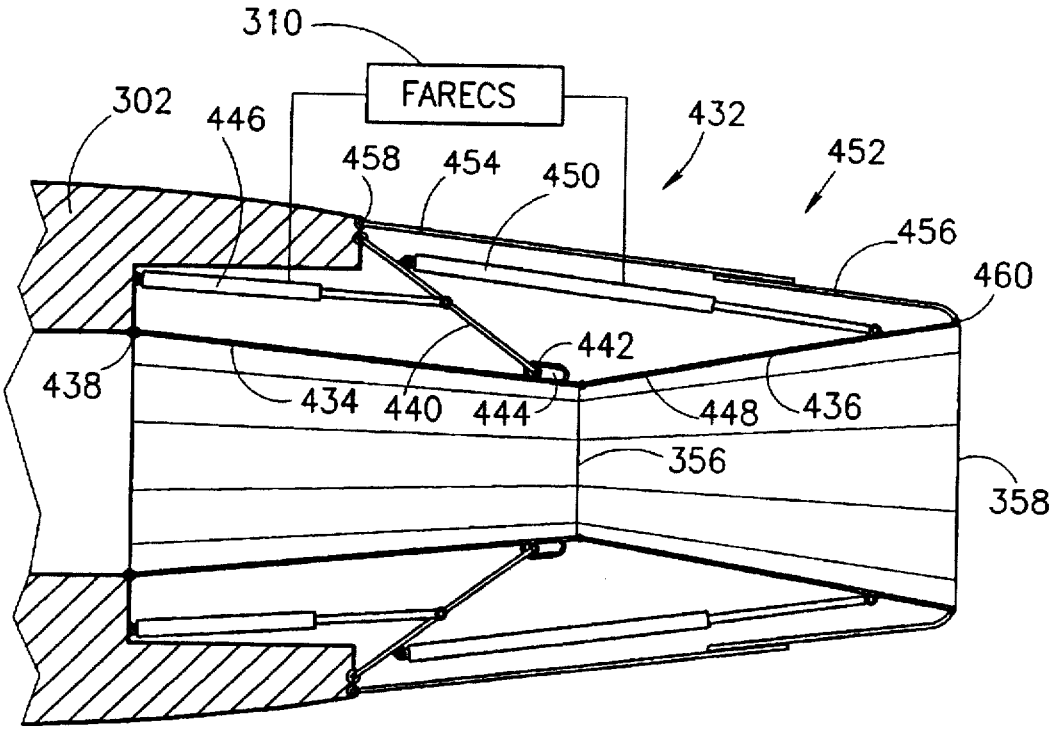
Figure 8F:
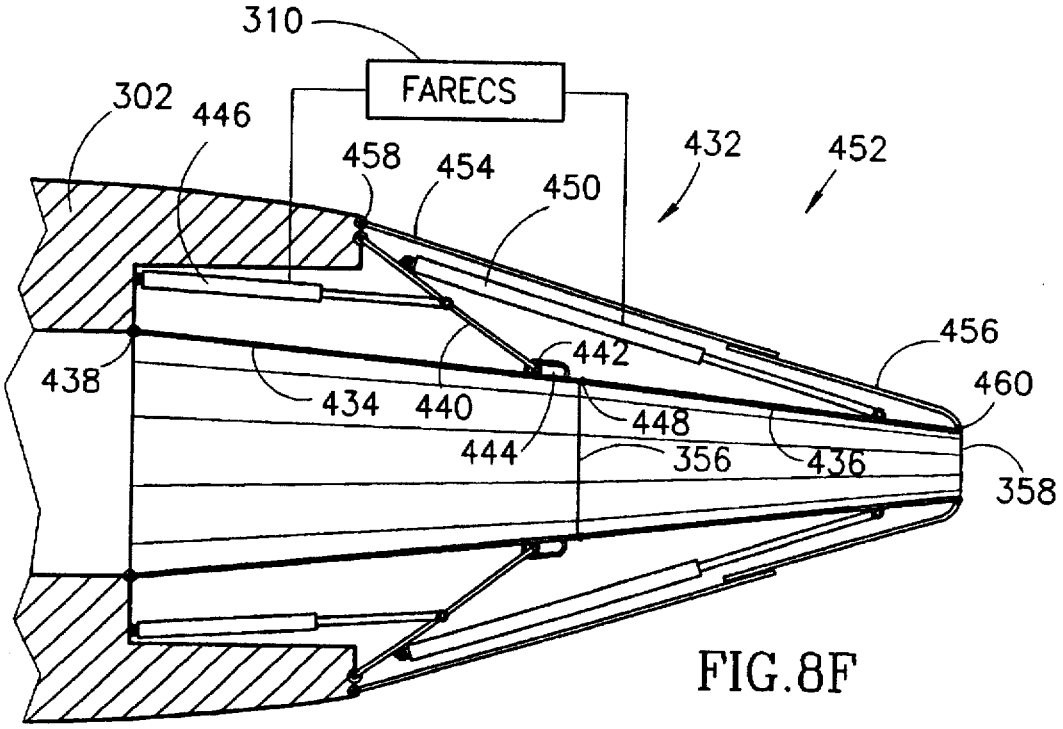

FIGS. 8*c*–8*f* illustrate the four basic modes of operation of nozzle 308 in which FIG. 8*c* shows nozzle 308 with a fully open throat and a fully open exit for moderate-high speed acceleration, FIG. 8*d* shows nozzle 308 with a fully open throat and a fully closed exit for moderate-low speed acceleration, FIG. 8*e* shows nozzle with a fully closed throat and a fully open exit for economic high speed cruise while FIG. 8*f* shows nozzle with a fully closed throat and a fully closed exit for thrust reversal or gentle thrust. As above-mentioned, the variable internal geometry of nozzle 308 can be varied continuously while overlying conic segments 454 and 456 present a hydrodynamic hiring at all times.

Turning back to FIG. 5, propulsion unit 300 includes a number of pressure transducers, temperature sensors and other devices for providing additional input to FARECS 310. These include, but not limited to: a temperature sensor 462 for measuring the temperature of the water in the vicinity of inlet 304; temperature sensors 464 and 466 for measuring the temperature of the compressed gas from supersonic gas injector 332 and subsonic gas injector 334 during its injection into mixing chamber 306, respectively; a pressure transducer 468 for measuring the static pressure at throat 356 of nozzle 306; and a pressure transducer 470 for measuring the static pressure at exit 358 of nozzle 308.

Figure 9A:
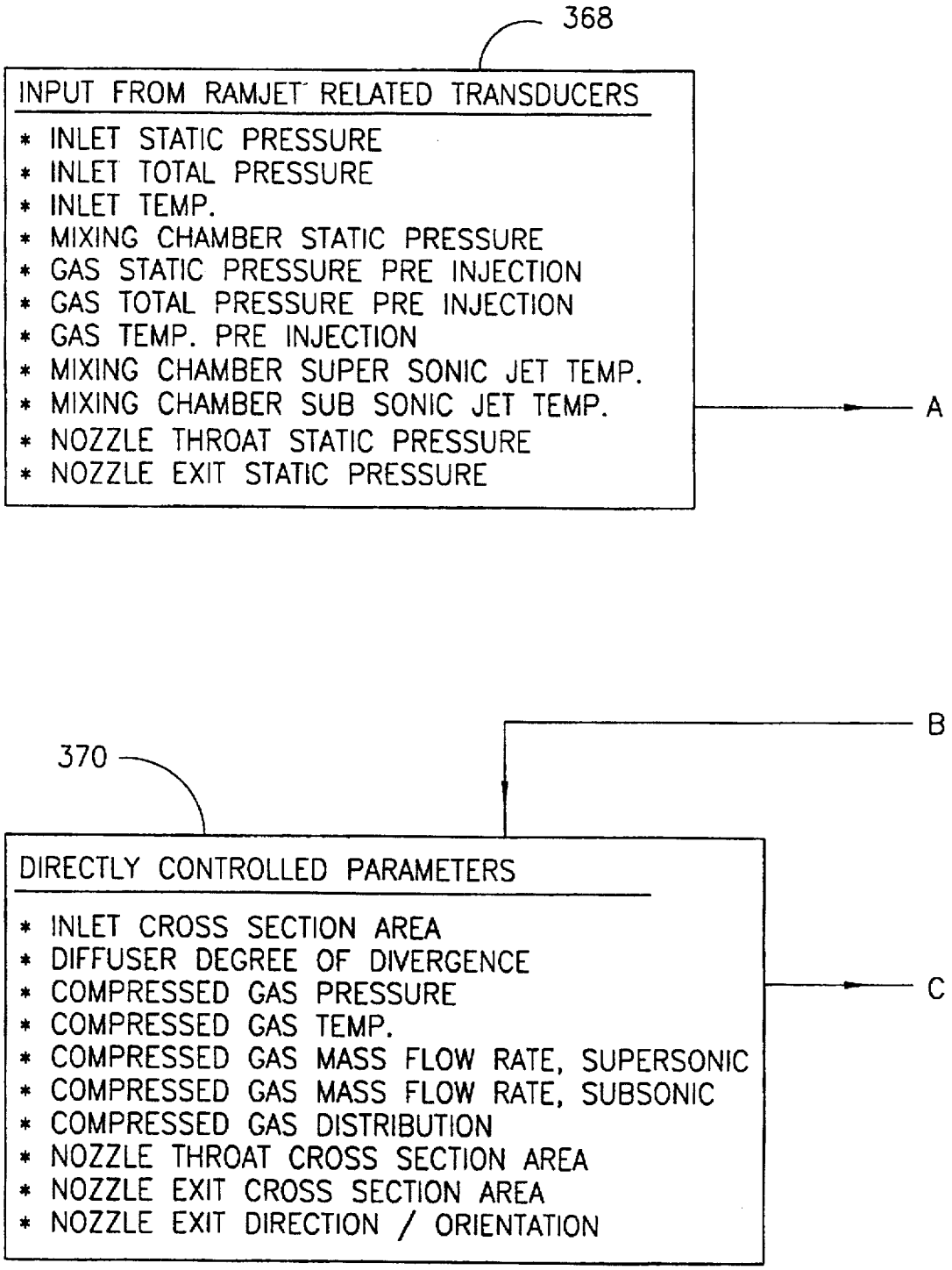
FIGS. 9A and 9B show a schematic block diagram of the Full Autonomy Ramjet Engine Control System (FARECS) integrated with the variable geometry propulsion unit.
Figure 9B:
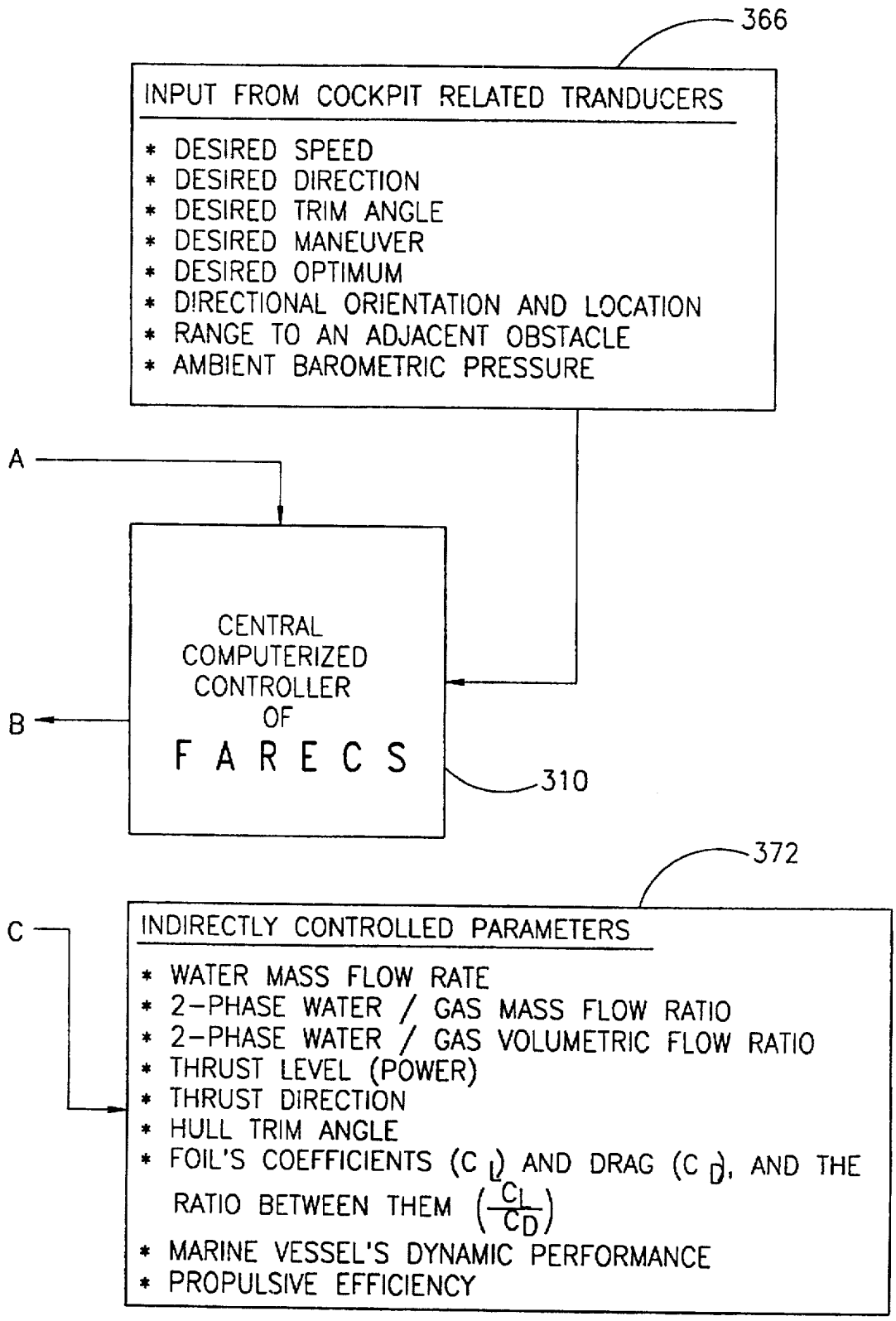

With reference now to FIG. 9, for the variable geometry propulsion unit 300, the input to FARECS 310 and the multi-channel output from FARECS 310 are now summarized in table format. Hence, the input from the cockpit of the craft is summarized in a block denoted 366 and entitled "INPUT FROM COCKPIT RELATED TRANSDUCERS" while the input from the pressure transducers, temperature sensors and other devices deployed within propulsion unit 300 is summarized in a block denoted 368 and entitled "INPUT FROM RAMJET RELATED TRANSDUCERS". In a similar fashion, the output from FARECS 310 is summarized in a block denoted 370 and entitled "DIRECTLY CONTROLLED PARAMETERS". The performance characteristics of propulsion unit 300 which are modified as a result of the regulation of the "DIRECTLY CONTROLLED PARAMETERS" are summarized in a block denoted 372 and entitled "INDIRECTLY CONTROLLED PARAMETERS".

Hence, the input in block 366 to FARECS 310 includes, but is not limited to: "Desired Speed" from a manual input interface such as a keyboard or a throttle; "Desired Direction"—forward, reverse, left, right and azimuth; "Desired Trim Angle"; "Desired Manoeuver"—complete deceleration at a pre-determined location, lateral translation, stationary rotation, etc.; "Desired Optimum"—thrust or efficiency; "Directional Orientation and Location"—from either navigation system or keyboard; "Range to an Adjacent Obstacle" such as a pier, a boat or a reef from subsystems such as a LASER range finder, a SONAR, a RADAR or a manual input interface such as a keyboard; and Ambient Barometric Pressure from transducer 312.

The input in block 368 includes, but is not limited to: "Inlet Static Pressure" from transducer 318; "Inlet Total Pressure" from transducer 320; "Inlet Temperature" from temperature sensor 462 "Mixing Chamber Static Pressure" from transducer 324; supersonic pre-injection "Gas Static Pressure" from transducer 342; supersonic pre-injection "Gas Total Pressure" from transducer 344; supersonic pre-injection "Gas Temperature" from temperature sensor 346; subsonic pre-injection "Gas Static Pressure" from transducer 350; subsonic pre-injection "Gas Total Pressure" from transducer 352; subsonic pre-injection "Gas Jet Temperature" from temperature sensor 354. "Mixing Chamber Supersonic Jet Temp." from temperature sensor 464; "Mixing Chamber Subsonic Jet Temp." from temperature sensor 466; "Nozzle Throat Static Pressure" from pressure transducer 468; and "Nozzle Exit Static Pressure" from pressure transducer 470.

The multi-channel output in block 370 includes, but is not limited to regulation of: "Inlet Cross section Area" of inlet cowl 314; "Diffuser Degree of Divergence" of diffuser 316; "Compressed Gas Pressure" supplied by compressed gas generator 322; "Compressed Gas Mass Flow Rate" of supersonic gas injector 332; "Compressed Gas Mass Flow Rate" of subsonic gas injector 334; "Compressed Gas Distribution" between supersonic gas injector 332, subsonic gas injector 334 and jet deflector (see FIG. 10); "Nozzle Throat Cross Section Area" of throat 356, "Nozzle Exit Cross Section Area" of exit 358; and "Nozzle Exit Direction/Orientation" of exit 358.

As shown in block 372, regulation of these parameters regulates, in turn, parameters including, but not limited to: "Water Mass Flow Rate" through propulsion unit 300; "2-Phase Water/Gas Mass Flow Ratio"; "2-Phase Water/Gas Volumetric Flow Ratio"; "Thrust Level (Power)" of propulsion unit 300; "Thrust Direction" of nozzle 308; "Hull Trim Angle"; "Foil's Coefficients of Lift ($C_L$) and Drag ($C_D$), and the Ratio between them ($C_L/C_D$)"; "Marine Vessel's Dynamic Performance" such as Stability (Roll, Pitch and Yaw), Sea Keeping, Drag vs. Speed and Take Off Speed; "Propulsive Efficiency" of propulsive unit 300.

As before the aim of the FARECS 310 is to optimize the propulsive potential of propulsion unit 300 through optimization of the marine vessel's total handling characteristics such as controllability, maneuverability, safety, readiness and maintainability. Typically, FARECS 310 also interfaces with several dynamic aspects of the craft including, but not limited to, the power plant's RPM, the bypass or activation of one or more heat exchangers as a part of the gas compression cycle, the lift and drag coefficients of the foils, the hull's trim angle and the dynamic loads (forces and moments) acting upon the hull and therefore can be expanded so as to incorporate other sub-controllers such as the power plant's controller and the hull's dynamic stabilizing controller.

Figure 10A:
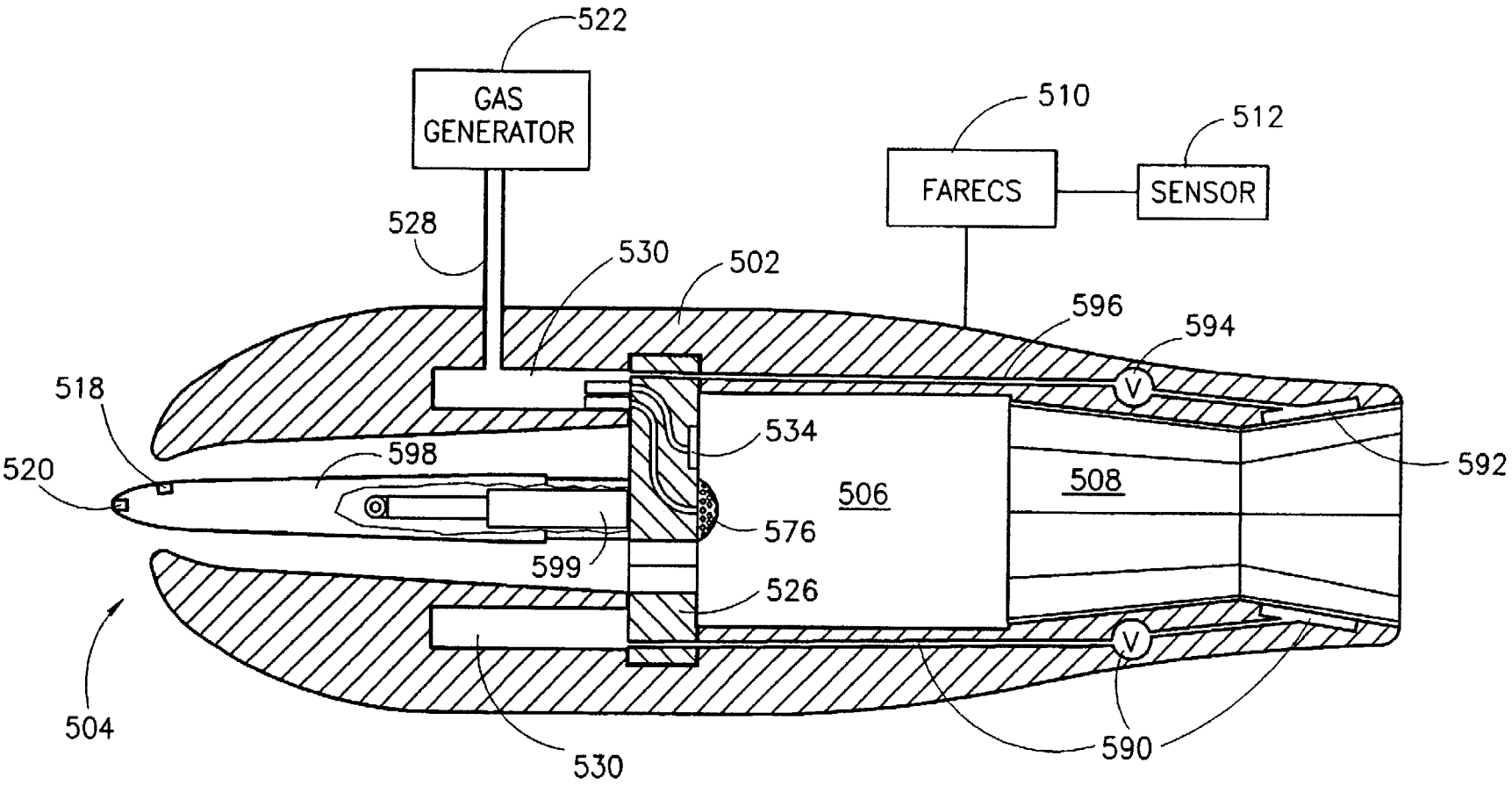
FIGS. 10*a* and 10*b* show cross sectional views of a second variable geometry embodiment of the underwater two-phase ramjet engine propulsion unit according to the teachings of the present invention showing the mouse of the propulsion unit in its most forward and rearward positions, respectively.
Figure 10B:
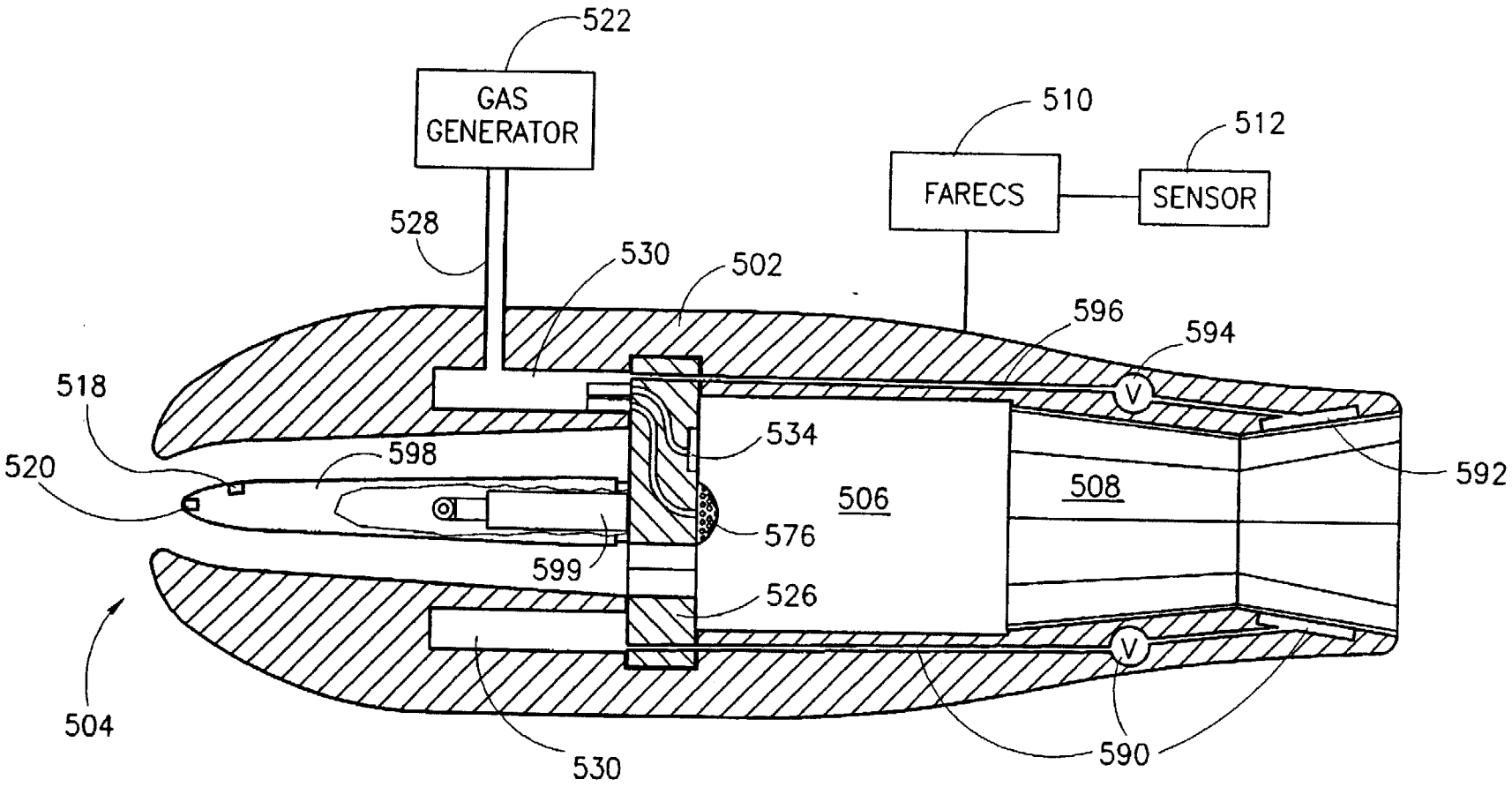

With reference now to FIGS. 10*a* and 10*b*, a second embodiment of a variable geometry propulsion unit, generally designated 500, is shown constructed and operative according to the teachings of the present invention. Propulsion unit 500 has a similar construction and operation as propulsion unit 100 and therefore similar elements are likewise numbered.

Propulsion unit 500 has a similar construction to propulsion unit 200 in view of the fact that its includes a center body 576 having a shower head 578 and arms 580. However, propulsion unit 500 demonstrates a far superior performance envelope over propulsion unit 200 by virtue of inlet 504 having a variable geometry, a FARECS 510 comparable to FARECS 310 and a steering capability provided by a jet deflector apparatus 590 requiring no external moving parts, such as the commonly used steerable hydraulic bucket.

The variable geometry of inlet 504 is accomplished by a cone shaped center body 598, commonly known in the art as a "mouse" telescopically mounted on center body 576. Mouse 598 can be extended and withdrawn along the axis of propulsion unit 500 by an actuator 599 under the control of FARECS 510. Actuator 599 can be a hydraulic actuator, a pneumatic actuator, an electro-mechanical actuator and the like. FIG. 10*a* shows mouse 598 in its fully forward mode such that the cross sectional area of inlet 504 is minimized while FIG. 10*b* shows mouse 598 in its fully rearward mode such that the cross sectional area of inlet 504 is maximized. The displacement of mouse 598 can be varied continuously from fully forward mode to its fully rearward mode, and vice versa.

Alternatively, mouse 598 can be selectively deformed such that it can vary its aspect ratio to regulate both the cross sectional area of inlet cowl 514 and the rate of change of the cross sectional area of diffuser 516. Deformation of mouse 598 can be achieved by either pneumatic, hydraulic or electro-mechanical means.

Jet deflector apparatus 590 includes a series of injectors 592 deployed around nozzle 508 for deflecting the direction of the two-phase jet as it is discharged from propulsion unit 500 and valves 594 on lines 596 extending between calming and regulation chamber 530 and injectors 592. Steering apparatus 590 is under the control of FARECS 510 which regulates valves 594 and typically includes four injectors 592 such that propulsion unit 500 can be steered and the craft can be trimmed. It should be noted that jet deflector apparatus 590 can also be implemented with fixed geometry two-phase ramjet engine propulsion units, for example, propulsion units 100 and 200.

With reference now to FIGS. 11*a*–11*d*, a third embodiment of a variable geometry propulsion unit, generally designated 600, is shown constructed and operative according to the teachings of the present invention. Propulsion unit 600 has a similar construction and operation as propulsion unit 100 and therefore similar elements are likewise numbered while additional elements are numbered starting from 700.

Propulsion units 600 are typically integrated with a foil 700 of a hydrofoil craft, foilcat craft or an SES craft equipped with at least one foil. Foil 700 includes side walls 702 and 704, an upper surface 706, a lower surface 708 and is connected to the hull of a craft via a vertical strut 710 through which passes all control cables to FARECS 610, compressed gas lines from compressed gas generator 622, etc. Foil 700 typically includes an array of propulsion units 600, in this case, six propulsion units denoted 600*a*–600*f*. The construction and operation of propulsion units 600*a*–600*f* are now described with reference to propulsion unit 600*a*.

Figure 11A:
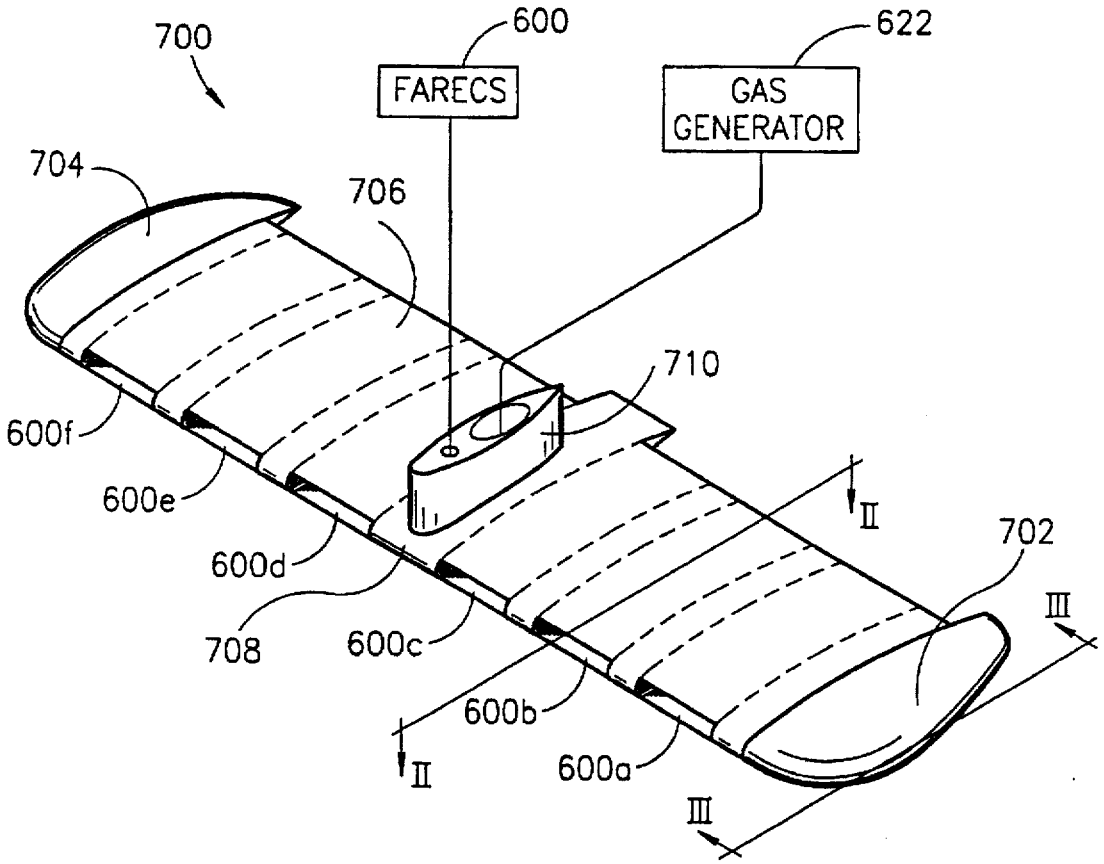
FIG. 11*a* shows a perspective view of a third variable geometry embodiment of the underwater two-phase ramjet engine propulsion unit according to the teachings of the present invention.
Figure 11B:
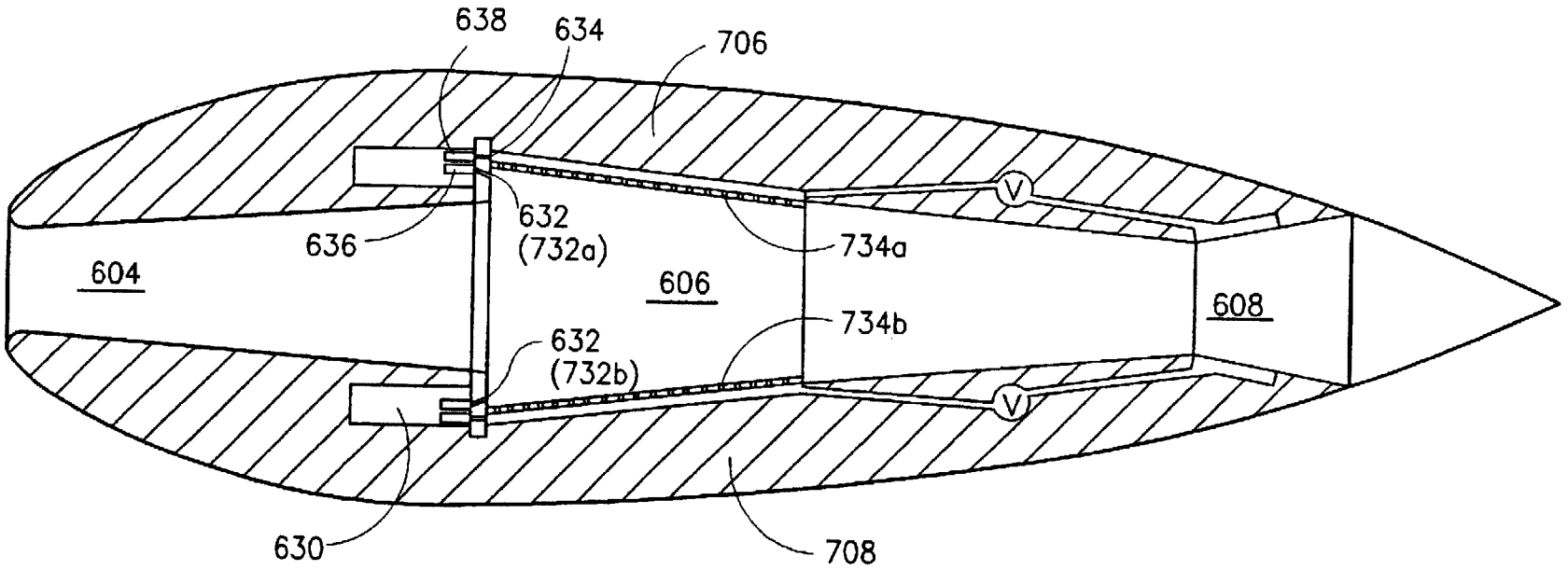
FIGS. 11*b* and 11*c* show a cross-sectional side view along line II—II and a schematic sectional top view along line III—III of the propulsion unit, respectively.
Figure 11C:
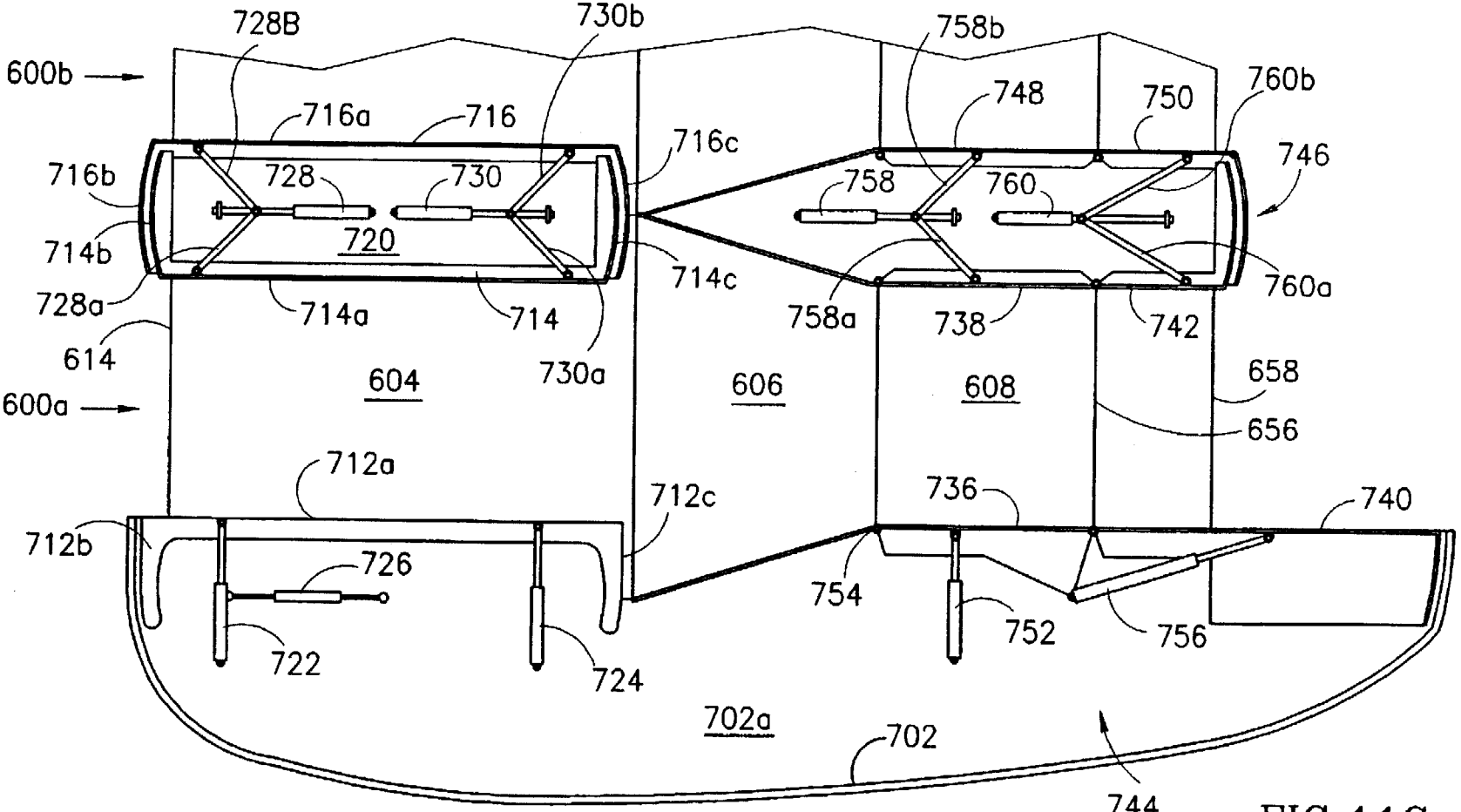
Figure 11D:
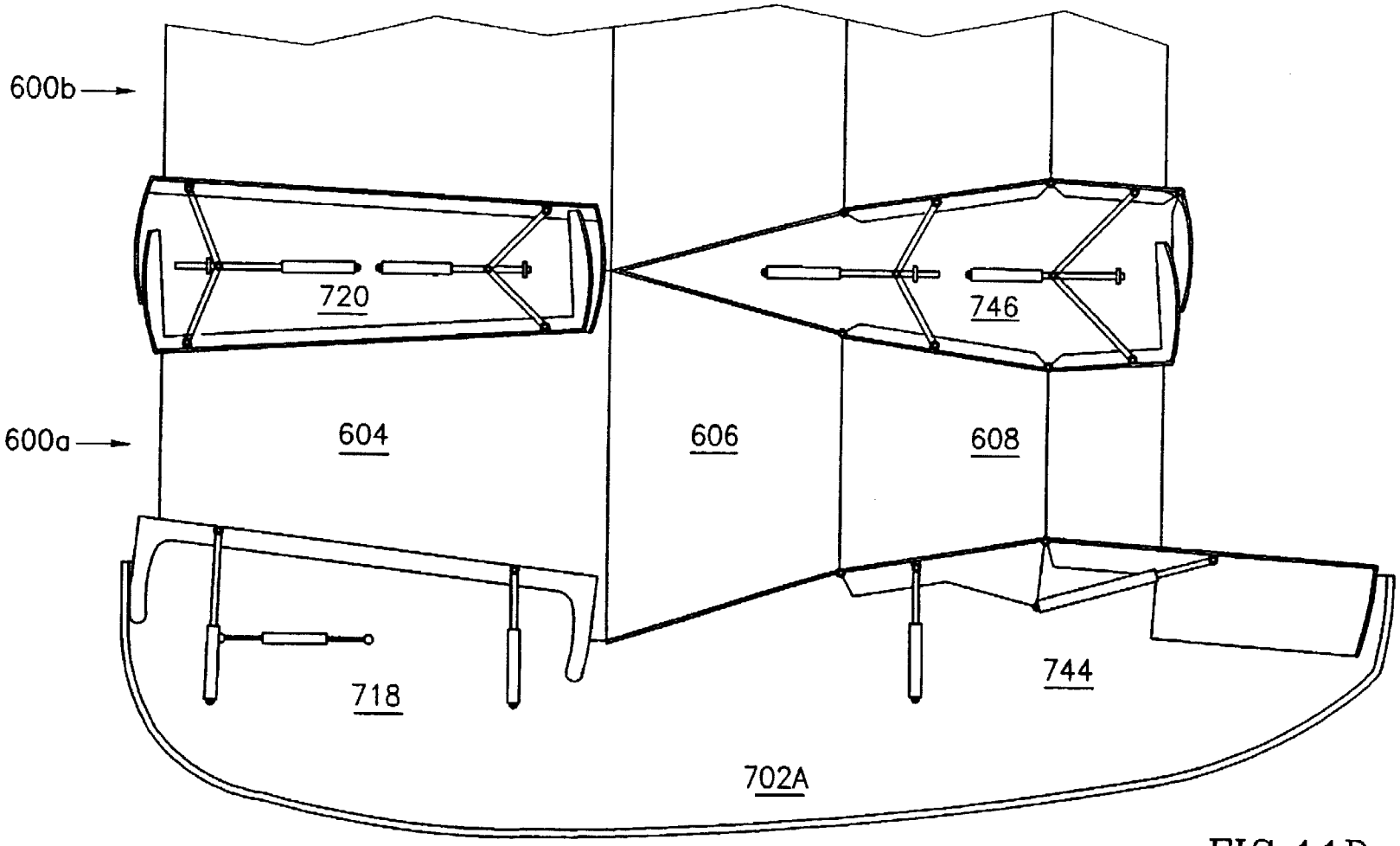
FIG. 11*d* shows a schematic sectional top view along III—III of the propulsion unit revealing a typical mode of operation of the propulsion unit.

With reference now to FIGS. 11*b*–11*d*, inlet 604, mixing chamber 606 and nozzle 608 of propulsion unit 600*a* present a generally rectangular flow duct. In this case, in contrast to the configurations described hereinabove, the variable geometry of propulsion unit 600 is achieved through the regulation of the width of the rectangular flow duct rather than the regulation of the diameter of a cylindrical flow duct as will become apparent hereinbelow.

The cross sectional area of inlet cowl 614 and the rate of change of the cross sectional area of diffuser 616 are regulated by the angle of inclination of a left inlet wall 712 and the angle of inclination of a right inlet wall 714 with respect to the longitudinal axis of propulsion unit 600*a*. Left inlet wall 712 has a generally U-shaped profile including a front surface 712*a* forming portion of the rectangular flow duct of propulsion unit 600*a* and side surfaces 712*b* and 712*c* which are received by side wall 702. Right inlet wall 714 has a generally U-shaped profile including a front surface 714*a* forming portion of the rectangular flow duct of propulsion unit 600*a* and side surfaces 712*b* and 712*c* which are received by side surfaces 716*b* and 716*c* of a left inlet wall 716 of propulsion unit 600*b*. Side surfaces of inlet walls 712, 714 and 716 are provided for presenting a generally continuous hydrodynamic hiring to an incoming flow of water.

The displacement of left inlet wall 712 is governed by an inlet kinematic mechanism, generally designated 718, while the displacement of right inlet wall 714 is governed by an inlet kinematic mechanism, generally designated 720. As can be seen, inlet kinematic mechanism 720 preferably also governs the displacement of left inlet wall 716 in such an arrangement that inlet walls 714 and 716 move in unison. Inlet deflector mechanism 718 is deployed within a volume 702*a* provided by side wall 702 while inlet deflector mechanism 720 is deployed within a volume defined between right inlet wall 714 and left inlet wall 716. Both inlet kinematic mechanisms 718 and 720 are under the control of FARECS 610.

Inlet kinematic mechanism 718 includes a pair of pivotally mounted actuators 722 and 724 for determining the angle of inclination of front surface 712*a* of inlet wall 712 and a pivotally mounted actuator 726 for urging side surface 712*b* against side wall 702. Inlet kinematic mechanism 720 includes a front actuator 728 having arms 728*a* and 728*b* connected toward the front part of front surfaces 714*a* and 716*a*, respectively, and a rear actuator 730 having arms 730*a* and 730*b* connected toward the rear part of front surfaces 714*a* and 716*a*, respectively. The degree of actuation of each of actuators 728 and 730 determines the inclination of front surfaces 714*a* and 716*a*.

Turning now to mixing chamber 606, the cross sectional area of mixing chamber 606 is greater than the cross sectional area of inlet 604 such that the flow of water through propulsion unit 600 is suddenly expanded, thereby enabling a greater quantity of compressed gas to be injected thereinto. Supersonic gas injector 632 is typically implemented as upper and lower arrays 732*a* and 732*b* of converging-diverging nozzles deployed between regulation chamber 630 and mixing chamber 606 for oblique injection of compressed gas toward the axis of mixing chamber 606 while subsonic gas injector 634 is preferably in the form of upper and lower multi-modal perforated sheets 734*a* and 734*b* for injection of compressed gas towards the axis of mixing chamber 606. As before, FARECS 610 regulates the mass gas flow rate, pressure and temperature of the compressed gas provided by compressed gas generator 622 and the distribution of compressed gas between supersonic gas injector 632 and subsonic gas injector 634 through the use of mass flow rate controllers, 636 and 638, respectively.

In a similar manner to inlet 604, the internal geometry of nozzle 608 is determined by the inclination of a left throat wall 736 and a right throat wall 738 for regulating the cross sectional area of throat 656 and a left exit wall 740 and a right exit wall 742 for regulating the cross sectional area of exit 658. The displacement of left throat wall 736 and left exit wall 740 is governed by a nozzle kinematic mechanism, generally designated 744, while the displacement of right throat wall 738 and right exit wall 742 is governed by a throat kinematic mechanism, generally designated 746. As can be seen, nozzle kinematic mechanism 746 preferably also governs the displacement of the left throat wall 748 and the left exit wall 750 of propulsion unit 600*b* in such an arrangement that throat walls 738 and 748 and exit walls 742 and 750 move in unison. Both nozzle kinematic mechanisms 744 and 746 are under the control of FARECS 610.

Nozzle deflector mechanism 744 is deployed within a volume 702*a* provided by side wall 702 while nozzle deflector mechanism 746 is deployed within a volume defined between left throat wall 736 and left exit wall 740 and right throat wall 738 and right exit wall 742. Nozzle kinematic mechanism 744 includes a pivotally mounted actuator 752 for determining the angle of inclination of throat wall 736 with respect to a pivot 754 and a pivotally mounted actuator 756 for determining the angle of inclination of exit wall 740 with respect to throat wall 736. Nozzle kinematic mechanism 746 includes a front actuator 758 having arms 758*a* and 758*b* connected toward the front part of throat walls 738 and 748, respectively, and a rear actuator 760 having arms 760*a* and 760*b* connected toward the rear part of exit walls 742 and 750, respectively. The degree of actuation of actuators 758 determines the inclination of throat walls 738 and 748 while the degree of actuation of actuators 760 determines the inclination of exit walls 742 and 750.

Since propulsion unit 600 not only lends itself as a lifting surface of the craft but also adds no drag, it thereby dramatically reduces the drag of the craft at high speed beyond about 30 knots. The use of jet deflection allows the trim angle of the craft and the hydrodynamic lift and drag of the foil to be controlled at the same time such that the FARECS can be integrated with the dynamic stabilizing control (roll, pitch and yaw) of the craft.

When a craft is equipped with several propulsion units of this type, such as in a hydrofoil configuration, a combination of forward deflected thrust commands to some of the units, with a thrust reversal command to other units, results in a pure lateral translation motion. A different combination of forward and reverse commands results in a pure rotational translation motion.

In hydrofoil vessels, the ability to divert the thrust jet vertically creates super-circulation over the foils, thereby providing regulation over the drag vs. speed characteristic of the craft. Super-circulation induces changes in hydrodynamic lift, drag and moments, exerted upon the foils, and through them upon the entire vessel such that, as a result, the trim angle of the craft changes in a controllable manner. Control over the drag vs. speed characteristic means that the propulsive efficiency and economy of the craft can be improved significantly by minimizing the drag at any given cruise speed or, alternatively, that the stopping distance of the craft may be minimized by maximizing the drag at any given cruise speed.

Furthermore, the ability to control the hydrodynamic lift of the foils, the drag and the moments of the foils, and the lateral distribution of these parameters along the foils, creates an effect of moving foils, with a variable curvature, similar to fish foils, ensures control over the dynamic stability of the craft, thereby improving safety, agility, efficiency and maneuverability. Such unprecedented flexibility enables calming and smoothing of the ride even in a rough sea up to limitations which derive from the craft's structure and geometrical design. Consequently, higher commercial cruise speeds are made available and feasible, without any compromise of passengers comfort or safety, irrespective of weather conditions.

Overall, the propulsion units taught by the present invention enable highly efficient, high performance crafts superseding any existing craft not only in terms of direct performance such as speed, sea keeping and maneuverability, but also in terms of reliability, safety, human engineering, user friendliness and maintainability.

While the invention has been described with respect to a limited number of embodiments, it will be appreciated that many variations, modifications and other applications of the invention may be made.

What is claimed is:

1. An underwater two-phase ramjet engine propulsion unit, comprising:

(a) an inlet for receiving a flow of water, said inlet having a selectively variable internal geometry;

(b) compressed gas injection means for injecting compressed gas into said flow of water;

(c) a mixing chamber for mixing said compressed gas with said flow of water to provide a two-phase flow of working fluid;

(d) a control system for controlling said compressed gas injector means so as to maintain said two-phase flow of working fluid in the bubbly regime; and (e) a nozzle for accelerating said two-phase flow of working fluid so as to generate a two-phase jet, said compressed gas injection means including a supersonic gas injector.

2. The propulsion unit as in claim 1, wherein said inlet includes an inlet cowl having a selectively variable cross sectional area.

3. The propulsion unit as in claim 2, wherein said inlet includes a plurality of overlapping conic segments so as to enable the cross sectional area of said inlet cowl to be selectively varied.

4. The propulsion unit as in claim 2, wherein said propulsion unit includes a mouse displaceable along the axis of said propulsion unit so as to enable the cross sectional area of said inlet cowl to be selectively varied.

5. The propulsion unit as in claim 2, wherein said propulsion unit includes at least one displaceable inlet wall so as to enable the cross sectional area of said inlet cowl to be selectively varied.

6. The propulsion unit as in claim 2, wherein the cross sectional area of said inlet cowl can be selectively varied between about a tenth of the cross sectional area of said mixing chamber and about a half of the cross sectional area of said mixing chamber.

7. The propulsion unit as in claim 1, wherein said inlet includes a diffuser having a selectively variable rate of change of cross sectional area along the longitudinal axis of said propulsion unit.

8. The propulsion unit as in claim 7, wherein said diffuser includes a plurality of overlapping conic segments so as to enable the rate of change of the cross sectional area of said diffuser to be selectively varied.

9. The propulsion unit as in claim 7, wherein said propulsion unit includes a mouse displaceable along the axis of said propulsion unit so as to enable the rate of change of the cross sectional area of said diffuser to be selectively varied.

10. The propulsion unit as in claim 7, wherein said propulsion unit includes at least one displaceable inlet wall so as to enable the rate of change of the cross sectional area of said diffuser to be selectively varied.

11. The propulsion unit as in claim 7, wherein the angle of divergence of said diffuser can be selectively varied between about −10° and about 10°.

12. An underwater two-phase ramjet engine propulsion unit, comprising:

(a) an inlet for receiving a flow of water;

(b) compressed gas injection means for injecting compressed gas into said flow of water;

(c) a mixing chamber for mixing said compressed gas with said flow of water to provide a two-phase flow of working fluid;

(d) a control system for controlling said compressed gas injector means so as to maintain said two-phase flow of working fluid in the bubbly regime; and (e) a nozzle for accelerating said two-phase flow of working fluid so as to generate a two-phase jet, said nozzle having a selectively variable geometry, said compressed gas injection means including a supersonic gas injector.

13. The propulsion unit as in claim 12, wherein said nozzle includes a throat having a selectively variable cross sectional area.

14. The propulsion unit as in claim 13, wherein said nozzle includes a plurality of overlapping conic segments so as to enable said selectively variable cross sectional area.

15. The propulsion unit as in claim 13, wherein said nozzle includes at least one displaceable throat wall so as to enable said selectively variable cross sectional area.

16. The propulsion unit as in claim 13, wherein the cross sectional area of the throat of said nozzle can be selectively varied between about a third of the cross sectional area of said mixing chamber and about substantially the same as the cross sectional area of said mixing chamber.

17. The propulsion unit as in claim 12, wherein said nozzle includes an exit having a selectively variable cross sectional area.

18. The propulsion unit as in claim 17, wherein said nozzle includes a plurality of overlapping conic segments so as to enable said selectively variable cross sectional area.

19. The propulsion unit as in claim 17, wherein said nozzle includes at least one displaceable exit wall so as to enable said selectively variable cross sectional area.

20. The propulsion unit as in claim 17, wherein the cross sectional area of said exit can be selectively varied between about a quarter of the cross sectional area of said mixing chamber and about slightly greater than the cross sectional area of said mixing chamber.

* * * * *